US009249488B2

(12) United States Patent
Takasugi et al.

(10) Patent No.: US 9,249,488 B2
(45) Date of Patent: Feb. 2, 2016

(54) NI-BASE DUAL MULTI-PHASE INTERMETALLIC COMPOUND ALLOY CONTAINING NB AND C, AND MANUFACTURING METHOD FOR SAME

(75) Inventors: Takayuki Takasugi, Sakai (JP); Yasuyuki Kaneno, Sakai (JP)

(73) Assignee: OSAKA PREFECTURE UNIVERSITY PUBLIC CORPORATION, Sakai-shi, Osaka (JP)

( * ) Notice: Subject to any disclaimer, the term of this patent is extended or adjusted under 35 U.S.C. 154(b) by 544 days.

(21) Appl. No.: 13/636,579

(22) PCT Filed: Mar. 25, 2011

(86) PCT No.: PCT/JP2011/057418

§ 371 (c)(1),
(2), (4) Date: Sep. 21, 2012

(87) PCT Pub. No.: WO2011/118798

PCT Pub. Date: Sep. 29, 2011

(65) Prior Publication Data

US 2013/0008572 A1 Jan. 10, 2013

(30) Foreign Application Priority Data

Mar. 26, 2010 (JP) ..... 2010-073764
Mar. 26, 2010 (JP) ..... 2010-073766

(51) Int. Cl.
*C22F 1/10* (2006.01)
*C22C 19/03* (2006.01)

(52) U.S. Cl.
CPC .. *C22F 1/10* (2013.01); *C22C 19/03* (2013.01)

(58) Field of Classification Search
CPC ..... C22F 1/10; C22C 19/03
See application file for complete search history.

(56) References Cited

U.S. PATENT DOCUMENTS

2008/0175745 A1 7/2008 Takasugi et al.
2009/0120543 A1 5/2009 Takasugi et al.
2009/0308507 A1 12/2009 Chikugo et al.

FOREIGN PATENT DOCUMENTS

WO WO 2006/101212 A1 9/2006
WO WO 2007/086185 A1 8/2007
WO WO 2008/041592 A1 4/2008

OTHER PUBLICATIONS

Davis, Joseph R., ed. Nickel, cobalt, and their alloys. ASM international, 2000. pp. 302-304.*
PCT/ISA/210—International Search Report mailed Jun. 14, 2011, issued in PCT/JP2011/057418.

* cited by examiner

*Primary Examiner* — Jessee Roe
(74) *Attorney, Agent, or Firm* — Birch, Stewart, Kolasch & Birch, LLP

(57) ABSTRACT

The present invention provides an Ni-base dual multi-phase intermetallic compound alloy which has a dual multi-phase microstructure comprising a primary precipitate $L1_2$ phase and an ($L1_2$+$D0_{22}$) eutectoid microstructure, and which comprises: more than 5 atomic % and up to 13 atomic % of Al; at least 9.5 atomic % and less than 17.5 atomic % of V; more than 0 atomic % and up to 12.5 atomic % of Nb; more than 0 atomic % and up to 12.5 atomic % of C; and a remainder comprising Ni.

14 Claims, 31 Drawing Sheets

BASE ALLOY(base)

(a)

10 mm 0.2 NbC (b)

10 mm 1.0 NbC (c)

10 mm 5.0 NbC (d)

10 mm

ROOM TEMPERATURE (RT)

(a)

50 μm

1073 K (b)

50 μm (a) 0C-Nb (base)

(b) 0.1C-Nb (c) 0.3C-Nb (d) 0.5C-Nb (e) 1.0C-Nb (f) 2.0C-Nb (g) 4.0C-Nb (a) 0C-Nb (base)

(b) 0.1C-Nb (c) 0.3C-Nb (d) 0.5C-Nb (e) 1.0C-Nb (f) 2.0C-Nb (g) 4.0C-Nb

BASE ALLOY (base)

(a)

10 mm 0.2 TiC (b)

10 mm 1.0 TiC (c)

10 mm 5.0 TiC (d)

10 mm

NI-BASE DUAL MULTI-PHASE INTERMETALLIC COMPOUND ALLOY CONTAINING NB AND C, AND MANUFACTURING METHOD FOR SAME

TECHNICAL FIELD

The present invention relates to an Ni-base dual multi-phase intermetallic compound alloy and a method for manufacturing the same.

BACKGROUND ART

Conventionally, an Ni-base dual multi-phase intermetallic compound alloy has been known as an alloy that shows superior properties at high temperatures (see Patent Documents 1 to 3, for example). This alloy has a dual multi-phase microstructure composed of a primary precipitate $Ni_3Al$ ($L1_2$) phase and an Al (fcc) phase existing in channels (upper microstructure); and a lower microstructure including $Ni_3Al$ ($L1_2$) and $Ni_3V$ ($D0_{22}$) formed through a eutectoid transformation from the Al (fcc) at a low temperature. The alloy therefore has excellent mechanical properties at high temperatures.

RELATED ART DOCUMENTS

Patent Documents
Patent Document 1: Pamphlet of WO 2006/101212
Patent Document 2: Pamphlet of WO 2007/086185
Patent Document 3: Pamphlet of WO 2008/041592

SUMMARY OF THE INVENTION

Problems to be Solved by the Invention

The Ni-base dual multi-phase intermetallic compound alloy has comparable or superior properties to existing Ni-base alloys. Still, it has been desired to develop an Ni-base intermetallic compound alloy having more enhanced tensile strength and ductility characteristics in a wide temperature range from room temperature to high temperature. For example, it has been desired to develop an Ni-base dual multi-phase intermetallic compound alloy which is less likely to undergo intergranular fracture in order to sufficiently draw out the mechanical properties of the dual multi-phase microstructure of the alloy.

In view of the above-described circumstances, the present invention has been achieved to provide a dual multi-phase intermetallic compound alloy having enhanced tensile strength and ductility characteristics in a wide temperature range from room temperature to high temperature.

Means for Solving the Problems

The present invention provides an Ni-base dual multi-phase intermetallic compound alloy which has a dual multi-phase microstructure comprising a primary precipitate $L1_2$ phase and an ($L1_2$+$D0_{22}$) eutectoid microstructure, and which comprises: more than 5 atomic % and up to 13 atomic % of Al; at least 9.5 atomic % and less than 17.5 atomic % of V; more than 0 atomic % and up to 12.5 atomic % of Nb; more than 0 atomic % and up to 12.5 atomic % of C; and a remainder comprising Ni.

Effects of the Invention

Focusing on strength enhancement achievable by solid solution strengthening of C and intergranular fracture inhibition achievable by intergranular segregation of C, the inventors of the present invention have originated an idea by which C is introduced into an Ni-base dual multi-phase intermetallic compound alloy, and made intensive studies. As a result, the inventors of the present invention have found that the introduction of C into an Ni-base dual multi-phase intermetallic compound alloy containing Ni, Al, V and Nb leads to enhancement of the tensile strength and ductility characteristics to reach completion of the present invention.

The present invention provides an Ni-base dual multi-phase intermetallic compound alloy having enhanced tensile strength and ductility characteristics in a wide temperature range from room temperature to high temperature.

Hereinafter, various embodiments of the present invention will be described by way of examples. Configurations shown in the following description are merely exemplifications and the scope of the present invention is not limited thereto. No. 2 to No. 6, No. 8 to No. 13 and No. 15 to No. 19 are samples according to the embodiments of the present invention.

MODE FOR CARRYING OUT THE INVENTION

An Ni-base dual multi-phase intermetallic compound alloy according to the present invention comprises more than 5 atomic % and up to 13 atomic % of Al, at least 9.5 atomic % and less than 17.5 atomic % of V, more than 0 atomic % and up to 12.5 atomic % of Nb, more than 0 atomic % and up to 12.5 atomic % of C, and the remainder comprising Ni, and has a dual multi-phase microstructure comprising a primary precipitate $L1_2$ phase and an ($L1_2$+$D0_{22}$) eutectoid microstructure.

Here, the remainder comprising Ni may include inevitable impurities. Hereinafter, summing the atomic percentages of Al, V, Nb, C and Ni in the Ni-base dual multi-phase intermetallic compound alloy of the present invention becomes 100 atomic % as a composition, unless otherwise stated.

Figure 3:
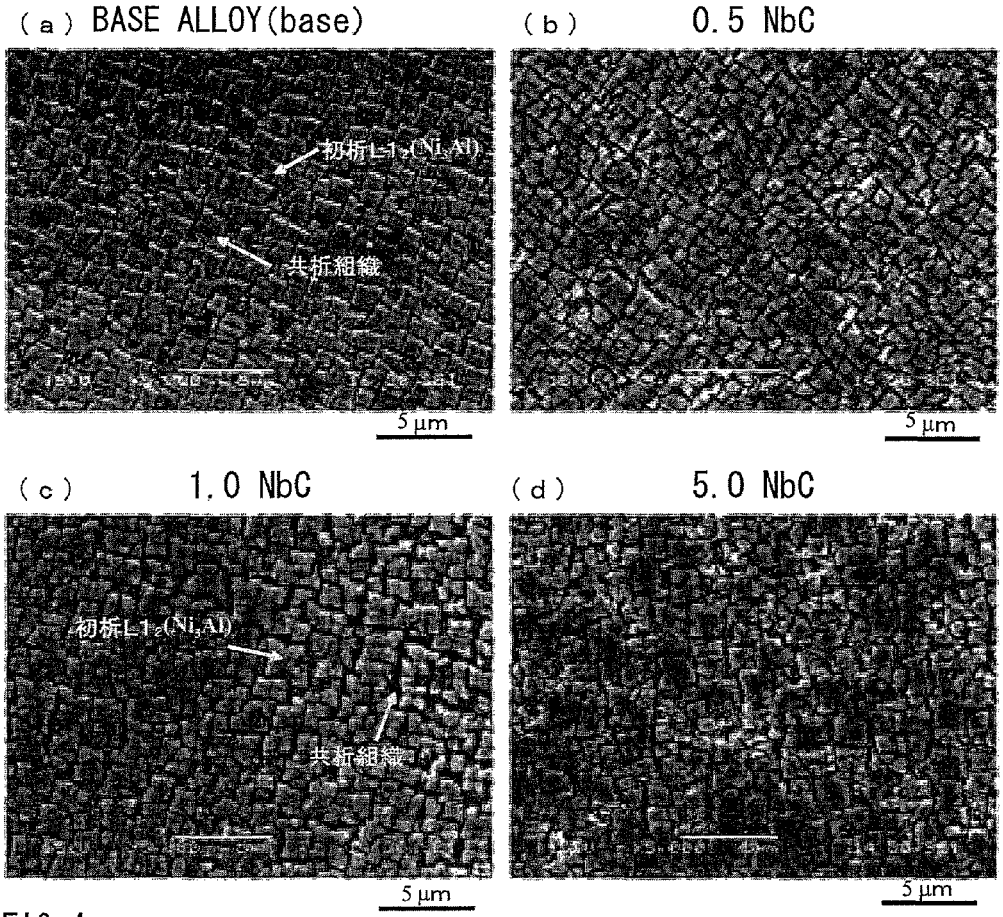
FIGS. 3 (*a*) to (*d*) are SEM photographs (5000 times) of Sample No. 1 (Reference Example), and No. 3, No. 4 and No. 6 (Examples).
Figure 4:
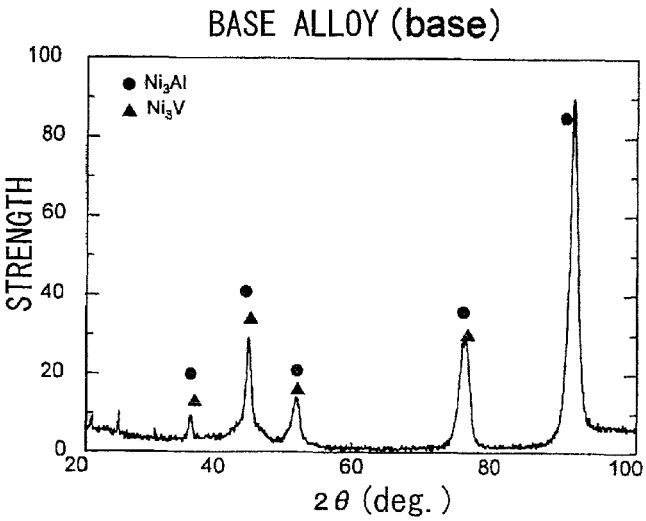
FIG. 4 is a graph showing a result of an X-ray measurement on Sample No. 1 (base) (Reference Example).
Figure 5:
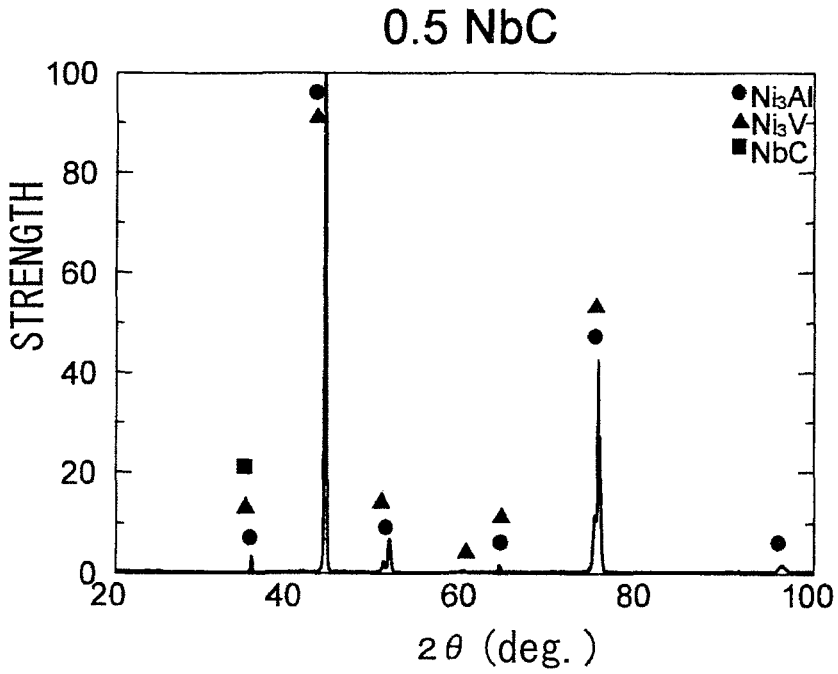
FIG. 5 is a graph showing a result of an X-ray measurement on Sample No. 3 (0.5 atomic % NbC) (Example).
Figure 6:
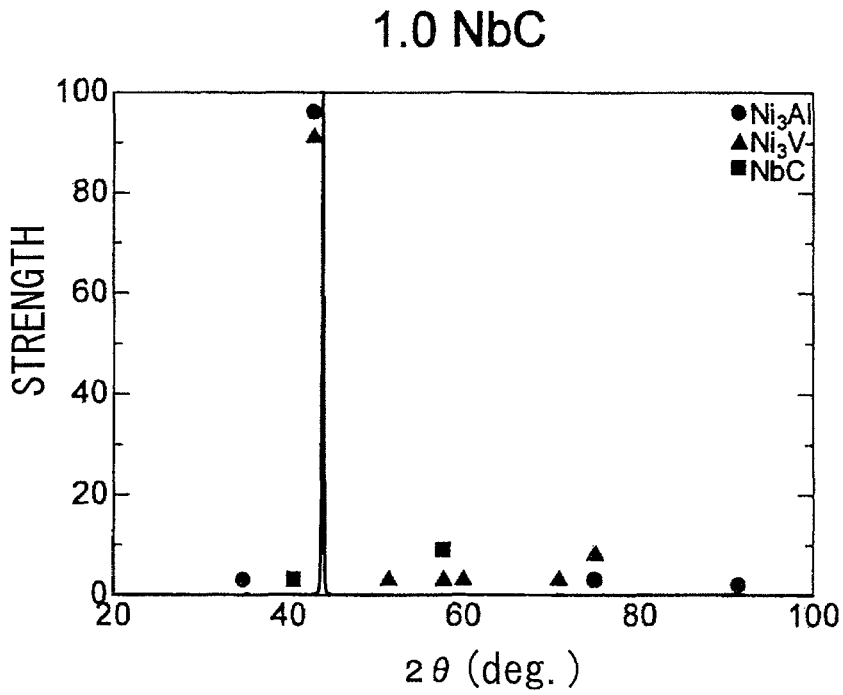
FIG. 6 is a graph showing a result of an X-ray measurement on Sample No. 4 (1.0 atomic % NbC) (Example).
Figure 7:
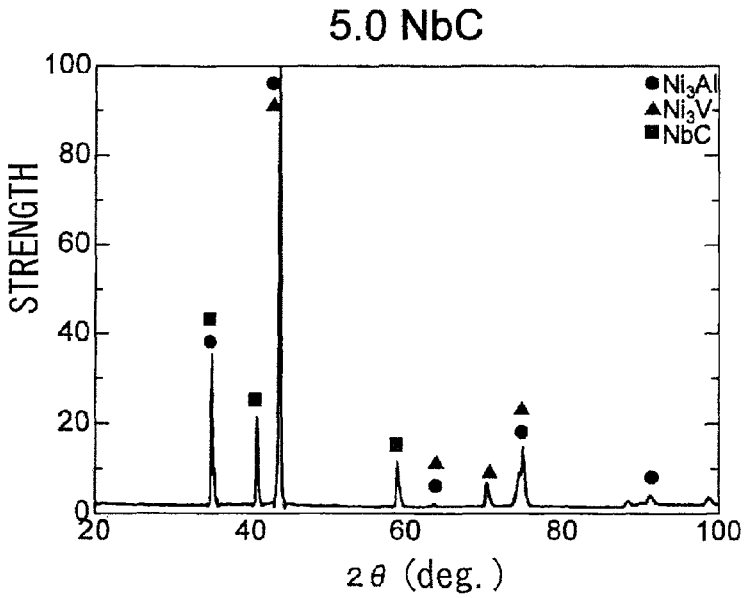
FIG. 7 is a graph showing a result of an X-ray measurement on Sample No. 6 (5.0 atomic % NbC) (Example).

In addition, the primary precipitate $L1_2$ phase is an $L1_2$ phase dispersed in an A1 phase as shown in FIG. 3, for example, and the ($L1_2$+$D0_{22}$) eutectoid microstructure is an eutectoid microstructure including $L1_2$ and $D0_{22}$ formed through decomposition of the A1 phase as shown in FIG. 3, for example.

Preferably, the Nb content is from 2.0 atomic % to 7.3 atomic % and the C content is more than 0 atomic % and up to 4.6 atomic %. (As will be indicated in Examples 1 to 5, the Nb content may be more than 3.0 atomic %, for example.)

More preferably, the Nb content is from 3.1 atomic % to 5.3 atomic %, and the C content is from 0.2 atomic % to 2.4 atomic %. The contents in these ranges allow enhancement of the tensile strength and the ductility characteristics.

Since the enhancement of the tensile strength and the ductility characteristics is owing to the development of a solid solution strengthening mechanism by C and to the intergranular fracture inhibition by the intergranular segregation of C, the Nb content and the C content may be the same or different. For example, the Nb content may be less than the C content. Furthermore, since the tensile strength and the ductility characteristics can be enhanced even when the Nb content and the C content are small, the Nb content and the C content may be about the same as the B content described later.

In addition, in an embodiment, the Ni-base dual multi-phase intermetallic compound alloy of the present invention may be formed by adding NbC to Al, V and Ni as the alloy materials.

That is, the alloy may be formed by adding NbC to the alloy materials including Ni as a main component, more than 5 atomic % and up to 13 atomic % of Al, and at least 9.5 atomic % and less than 17.5 atomic % of V. (In other words, the alloy may be the one obtained by adding TiC to these alloy materials, and melting and casting the materials.)

According to this embodiment, in which C is introduced into the materials of the Ni-base dual multi-phase intermetallic compound alloy as a carbide, the formation of the dual multi-phase microstructure is not interfered with, when the NbC added exists in the dual multi-phase microstructure matrix as second phase particles or when the NbC decomposes into Nb and C to be included in the dual multi-phase microstructure matrix as a solid solution. Thereby, the tensile strength and the ductility characteristics can be enhanced.

The amount of NbC to be added may be more than 0 atomic % and up to 12.5 atomic %. The alloy containing NbC is formed by producing an ingot from a molten metal prepared by adding NbC to the alloy materials. Preferably, the amount of NbC to be added is more than 0 atomic % and up to 4.6 atomic %, and more preferably, the amount is from 0.2 atomic % to 2.4 atomic %. The alloy containing NbC in such a range of amount can have more enhanced tensile strength and ductility characteristics.

The amount of NbC to be added is determined so that the sum of Ni, Al and V as the alloy materials and NbC added thereto becomes 100 atomic %.

In the above-mentioned configuration of the present invention, Nb and C may be contained in the Ni-base dual multi-phase intermetallic compound alloy as NbC. That is, the Ni-base dual multi-phase intermetallic compound alloy may contain Nb and C obtained through decomposition of NbC added, or the Ni-base dual multi-phase intermetallic compound alloy may contain NbC as well as Nb and C obtained through decomposition of NbC added.

In an embodiment, the Ni-base dual multi-phase intermetallic compound alloy of the present invention may have a microstructure different from the dual multi-phase microstructure, and the microstructure may contain NbC. When formed by adding NbC to Al, V and Ni as the alloy materials, the Ni-base dual multi-phase intermetallic compound alloy may have a dual multi-phase microstructure containing Nb and C obtained through decomposition of NbC added or may have a microstructure containing NbC in addition to the dual multi-phase microstructure. When large amounts of Nb and C are contained, for example, a microstructure different from the dual multi-phase microstructure is formed, and second phase particles (carbide particles) containing V, Nb and C as main components are formed.

In an embodiment, the Ni-base dual multi-phase intermetallic compound alloy of the present invention may be an alloy composed of Al, V, Nb and C as the alloy materials (that is, an alloy obtained by melting and casting these materials) or an alloy further containing Ti as a result of addition of TiC as well as the alloy formed by adding NbC.

In an embodiment, the Ni-base dual multi-phase intermetallic compound alloy of the present invention may contain B in addition to the above-mentioned components. That is, the B content may be 0 ppm by weight, or the B content may be more than 0 ppm by weight and up to 1000 ppm by weight. When both B and C are contained, B and C undergo intergranular segregation, which inhibits intergranular fracture, and therefore it is preferable that such a small amount of B is contained (for example, the B content is preferably more than 0 ppm by weight).

The B content is preferably from 50 ppm by weight to 1000 ppm by weight, and more preferably from 100 ppm by weight to 800 ppm by weight.

The B content is a value defined relative to the total weight of the composition of 100 atomic % including Al, V, Nb, C and Ni.

In the Ni-base dual multi-phase intermetallic compound alloy of the present invention, preferably, the Al content is from 6 atomic % to 10 atomic % and the V content is from 12.0 atomic % to 16.5 atomic %. The Al content and the V content in these ranges facilitate formation of the dual multi-phase microstructure.

The Ni-base dual multi-phase intermetallic compound alloy of the present invention may further contain Ti in addition to Al, V, Nb, C, Ni and inevitable impurities as described above. For example, the alloy may further contain Ti, and the Ti content may be more than 0.0 and up to 4.6.

A first method for manufacturing an Ni-base dual multi-phase intermetallic compound alloy of the present invention comprises the steps of: forming a microstructure in which a primary precipitate $L1_2$ phase and an A1 phase coexist by slow cooling a molten metal containing more than 5 atomic % and up to 13 atomic % of Al, at least 9.5 atomic % and less than 17.5 atomic % of V, more than 0 atomic % and up to 12.5 atomic % of Nb, more than 0 atomic % and up to 12.5 atomic % of C, and the remainder comprising Ni; and decomposing the A1 phase into an $L1_2$ phase and a $D0_{22}$ phase by cooling the microstructure in which the primary precipitate $L1_2$ phase and the A1 phase coexist.

A second method for manufacturing an Ni-base dual multi-phase intermetallic compound alloy of the present invention comprises the steps of: preparing an ingot from a molten metal containing more than 5 atomic % and up to 13 atomic % of Al, at least 9.5 atomic % and less than 17.5 atomic % of V, more than 0 atomic % and up to 12.5 atomic % of Nb, more than 0 atomic % and up to 12.5 atomic % of C, and the remainder comprising Ni; giving a first heat treatment to the ingot at a temperature at which a primary precipitate $L1_2$ phase and an A1 phase coexist; and decomposing the A1 phase into an $L1_2$ phase and a $D0_{22}$ phase by cooling after the first heat treatment.

In the first and second manufacturing methods, the step of preparing an ingot from a molten metal includes the step of preparing an ingot from a molten metal containing alloy materials including Ni as a main component, more than 5 atomic % and up to 13 atomic % of Al, at least 9.5 atomic % and less than 17.5 atomic % of V, more than 0 atomic % and up to 12.5 atomic % of Nb, and more than 0 atomic % and up to 12.5 atomic % of C.

A third method for manufacturing an Ni-base dual multi-phase intermetallic compound alloy of the present invention comprises the steps of: forming a microstructure in which a primary precipitate $L1_2$ phase and an A1 phase coexist by slow cooling a molten metal containing alloy materials including Ni as a main component, more than 5 atomic % and up to 13 atomic % of Al, at least 9.5 atomic % and less than 17.5 atomic % of V, and more than 0 atomic % and up to 12.5 atomic % of NbC; and decomposing the A1 phase into an $L1_2$ phase and a $D0_{22}$ phase by cooling the microstructure in which the primary precipitate $L1_2$ phase and the A1 phase coexist.

A forth method for manufacturing an Ni-base dual multi-phase intermetallic compound alloy of the present invention comprises the steps of: preparing an ingot from a molten metal containing alloy materials including Ni as a main component, more than 5 atomic % and up to 13 atomic % of Al, at least 9.5 atomic % and less than 17.5 atomic % of V, and more than 0 atomic % and up to 12.5 atomic % of NbC; giving a first heat treatment to the ingot at a temperature at which a primary precipitate $L1_2$ phase and an A1 phase coexist; and decomposing the A1 phase into an $L1_2$ phase and a $D0_{22}$ phase by cooling after the first heat treatment.

Here, the molten metal can be casted with a ceramic mold or with a metal mold wrapped with a heat insulating material, for example.

In the step of preparing an ingot from a molten metal containing NbC, the molten metal is one prepared by adding NbC to Ni, Al and V as the alloy materials. Preferably, the NbC content (amount of NbC to be added) is more than 0 atomic % and up to 4.6 atomic %, and more preferably, the NbC content is from 0.2 atomic % to 2.4 atomic %.

In the embodiments, these manufacturing methods may further comprise homogenization heat treatment or solution heat treatment in addition to the above-mentioned steps. The homogenization heat treatment or the solution heat treatment may be performed at a temperature from 1503 K to 1603 K, for example.

Alternatively, the first heat treatment may serve as the homogenization heat treatment or the solution heat treatment.

In the first and second manufacturing methods of the present invention, Al, V, Nb, C and Ni make up a composition of 100 atomic % in total. In the third and forth manufacturing methods of the present invention, on the other hand, the NbC content (amount of NbC to be added) is determined so that the sum of Ni, Al and V as the alloy materials and NbC added thereto becomes 100 atomic %. In the step of preparing an ingot from a molten metal, the molten metal means one obtained by adding NbC in the above-mentioned content (amount) to the alloy materials so as to give 100 atomic %.

The embodiments shown herein may be combined with one another. In this description, "from A to B" means that numerical values A and B are included in the range. (The unit atomic % may be represented as at. %.)

Hereinafter, each element in these embodiments will be described in detail.

Specifically, the Al content is more than 5 at. % and up to 13 at. %, for example, 5.5, 6, 6.5, 7, 7.5, 8, 8.5, 9, 9.5, 10, 10.5, 11, 11.5, 12, 12.5 or 13 at. %. The Al content may range between any two of the numeral values exemplified as the specific contents.

Specifically, the V content is at least 9.5 at. % and less than 17.5 at. %, for example, 9.5, 10, 10.5, 11, 11.5, 12, 12.5, 13, 13.5, 14, 14.5, 15, 15.5, 16, 16.5 or 17 at. %. The V content may range between any two of the numeral values exemplified as the specific contents.

Specifically, the Nb content is more than 0.0 at. % and up to 12.5 at. %, and preferably from 2.0 atomic % to 7.3 atomic %. For example, the Nb content is 0.1, 0.5, 1, 1.5, 2.0, 2.5, 2.7, 2.8, 2.9, 3.0, 3.1, 3.2, 3.3, 3.4, 3.5, 3.9, 4, 4.5, 5, 5.2, 5.3, 5.5, 6, 6.5, 7, 7.2, 7.3, 7.5, 8, 8.5, 9, 9.5, 10, 10.5, 11, 11.5, 12 or 12.5 at. %. The Nb content may range between any two of the numeral values exemplified as the specific contents.

Specifically, the C content is more than 0 at. % and up to 12.5 at. %, for example, 0.1, 0.2, 0.3, 0.4, 0.5, 0.6, 0.9, 1, 1.5, 2, 2.3, 2.4, 2.5, 3, 3.5, 4, 4.5, 4.6, 5, 5.5, 6, 6.5, 7, 7.5, 8, 8.5, 9, 9.5, 10, 10.5, 11, 11.5, 12 or 12.5 at. %.

Alternatively, the Nb content and the C content may be obtained by adding NbC to the material elements and melting the same. In this case, specifically, the NbC content is more than 0 at. % and up to 12.5 at. %, for example 1, 2, 3, 4, 5, 10, 12 or 12.5 at. %. Preferably, the NbC content is more than 0 at. % and up to 4.6 at. %. For example, the NbC content is 0.1, 0.2, 0.3, 0.4, 0.5, 0.6, 0.9, 1, 1.5, 2, 2.3, 2.4, 2.5, 3, 3.5, 4, 4.5 or 4.6 at. %. The Nb content, the C content and the NbC content may range between any two of the numeral values exemplified as the specific contents.

The amount of NbC to be added is determined so that the sum of Ni, Al and V as the alloy materials and NbC added thereto becomes 100 atomic %.

Specifically, the Ni content (content percentage) is preferably 73 to 77 at. %, and more preferably 74 to 76 at. %, because such ranges allow the ratio of the Ni content to the total of the (Al, V and Nb) contents to be approximately 3:1, discouraging development of any other phases than the $L1_2$ phase and the $D0_{22}$ phase that constitute the dual multi-phase microstructure. Specifically, the Ni content is 73, 73.5, 74, 74.5, 75, 75.5, 76, 76.5 or 77 at. %, for example. The Ni content may range between any two of the numeral values exemplified as the specific contents.

Specifically, the B content is from 50 ppm by weight to 1000 ppm by weight, for example 50, 100, 150, 200, 250, 300, 350, 400, 450, 500, 550, 600, 650, 700, 750, 800, 850, 900, 950 or 1000 ppm by weight. The B content may range between any two of the numeral values exemplified as the specific contents. The B content is a value defined relative to the total weight of the composition of 100% by atom including Al, V, Nb, C and Ni.

According to an embodiment of the present invention, specific compositions of the Ni-base dual multi-phase intermetallic compound alloy are obtained by adding the above-mentioned content of B to the compositions shown in Tables 1 to 3, for example.

TABLE 1

| Ni | Al | V | Nb | C |
|---|---|---|---|---|
| 74.99 | 10 | 12 | 3 | 0.01 |
| 74.8 | 10 | 12 | 3.1 | 0.1 |
| 74.6 | 10 | 12 | 3.2 | 0.2 |
| 73.8 | 10 | 11 | 4 | 1.2 |
| 73.6 | 8 | 13 | 4.1 | 1.3 |
| 73 | 7 | 13 | 5 | 2 |
| 73.3 | 6 | 13 | 5.3 | 2.4 |
| 73.5 | 5.1 | 9.5 | 7.3 | 4.6 |

Unit: at. %

TABLE 2

| Ni | Al | V | Nb | C |
|---|---|---|---|---|
| 73.99 | 9 | 13 | 4 | 0.01 |
| 73.9 | 9 | 13 | 4 | 0.1 |
| 73.8 | 9 | 13 | 4 | 0.2 |
| 73.7 | 7 | 15 | 4 | 0.3 |
| 73 | 7 | 15 | 4 | 1 |

TABLE 2-continued

| Ni | Al | V | Nb | C |
|---|---|---|---|---|
| 73.7 | 7 | 14 | 4 | 1.3 |
| 73 | 7 | 14 | 4 | 2 |
| 73.6 | 7 | 13 | 4 | 2.4 |
| 73.7 | 7 | 10.7 | 4 | 4.6 |

Unit: at. %

TABLE 3

| Ni | Al | V | Nb | C |
|---|---|---|---|---|
| 75 | 11 | 10 | 3 | 1 |
| 74.9 | 11 | 10 | 3.1 | 1 |
| 74.8 | 10 | 11 | 3.2 | 1 |
| 74.7 | 9 | 12 | 3.3 | 1 |
| 74.5 | 8 | 13 | 3.5 | 1 |
| 74.1 | 7 | 14 | 3.9 | 1 |
| 74 | 6 | 15 | 4 | 1 |
| 74.9 | 8 | 12 | 4.1 | 1 |
| 74.5 | 7 | 13 | 4.5 | 1 |
| 74.7 | 6 | 13 | 5.3 | 1 |
| 77 | 5.5 | 11 | 5.5 | 1 |
| 75.2 | 5.5 | 11 | 7.3 | 1 |

Unit: at. %

In the Ni-base dual multi-phase intermetallic compound alloy of the present invention, as will be described later, a dual multi-phase microstructure including a primary precipitate $L1_2$ phase and a ($L1_2$+$D0_{22}$) eutectoid microstructure is formed. The $L1_2$ phase is an $Ni_3Al$ intermetallic compound phase, and the $D0_{22}$ phase is an $Ni_3V$ intermetallic compound phase. In addition to the $L1_2$ phase and the $D0_{22}$ phase, depending on the composition, the dual multi-phase microstructure includes a $D0_a$ phase, which is an $Ni_3Nb$ intermetallic compound phase.

Next, a method for manufacturing the Ni-base dual multi-phase intermetallic compound alloy will be described.

First, raw metals are weighted so that each element accounts for the above-described proportion, and then melted by heating. The resulting molten metal is casted by cooling.

Here, NbC, carbide, may be used to give the proportions of Nb and C. With NbC, the dual multi-phase microstructure can be formed more easily, and an Ni-base dual multi-phase intermetallic compound alloy enhanced in tensile strength and ductility characteristics can be produced more easily.

Subsequently, the alloy materials casted are subjected to a first heat treatment at a temperature at which a primary precipitate $L1_2$ phase and an A1 phase coexist, and then cooled to decompose the A1 phase into an $L1_2$ phase and a $D0_{22}$ phase. Thereby, an Ni-base dual multi-phase intermetallic compound alloy having a dual multi-phase microstructure including a primary precipitate $L1_2$ phase and a ($L1_2$+$D0_{22}$) eutectoid microstructure is formed.

The $L1_2$ phase is an $Ni_3Al$ intermetallic compound phase, the A1 phase is an fcc solid solution phase, and the $D0_{22}$ phase is an $Ni_3V$ intermetallic compound phase.

The intermetallic compound alloy having a dual multi-phase microstructure can be manufactured by the methods disclosed in Patent Documents 1 to 3. For example, as disclosed in Patent Document 3, the intermetallic compound can be manufactured by the steps of: giving, at a temperature at which a primary precipitate $L1_2$ phase and an A1 phase coexist or at a temperature at which a primary precipitate $L1_2$ phase, an A1 phase and a $D0_a$ phase coexist, a first heat treatment to alloy materials (ingot or the like) obtained through melting and casting; and then cooling the resulting alloy materials to a temperature at which an $L1_2$ phase and a $D0_{22}$ phase and/or a $D0_a$ phase coexist, or giving a second heat treatment at the temperature to cause the A1 phase to transform into an ($L1_2$+$D0_{22}$) eutectoid microstructure to form a dual multi-phase microstructure.

In these Patent Documents, the formation of the upper multi-phase microstructure through the heat treatment at a temperature at which the primary precipitate $L1_2$ phase and the A1 phase coexist is performed as an independent process. Instead of the heat treatment, a molten metal in a process of producing an ingot of the intermetallic compound alloy may be slowly cooled down to achieve the formation of the upper multi-phase microstructure. During the slow cooling of the molten metal, the molten metal casted will stay at the temperature at which the primary precipitate $L1_2$ phase and the A1 phase coexist for a relatively long time, and therefore the upper multi-phase microstructure including the primary precipitate $L1_2$ phase and the A1 phase is formed as in the case the heat treatment.

The first heat treatment and the second heat treatment may be given according to the methods disclosed in Patent Documents 1 to 3. For the Ni-base dual multi-phase intermetallic compound alloy of the present invention, however, the first heat treatment is given at 1503 to 1603 K, for example, and it serves as a solution heat treatment (homogenization heat treatment).

Next, the present invention will be described in detail with reference to examples. In the following examples, cast materials were prepared and subjected to external observation, and then heat-treated to manufacture intermetallic compounds each having a dual multi-phase microstructure, and the intermetallic compounds were examined for mechanical properties.

Examples 1 to 5

Cast materials of Reference Example 1 and Examples 1 to 5 were prepared by melting and casting raw metals of Ni, Al, V and Nb (each having a purity of 99.9% by weight), and B and NbC powders (having a particle size of approximately 1 to 3 μm) in the proportions shown as No. 1 to No. 6 in Table 4 in a mold in an arc melting furnace. A melting chamber of the arc melting furnace was first evacuated, and the atmosphere in the arc melting furnace is replaced with an inert gas (argon gas). Non-consumable tungsten electrodes were employed as electrodes of the furnace, and a water-cooling copper hearth was employed as the mold. In the following description, the cast materials will be referred to as "Samples".

In Table 4, the numerical values for NbC and B are atomic percentages relative to a composition of 100 at. % in total containing Ni, Al, V and Nb.

TABLE 4

| | at. % | Ni | Al | V | Nb | NbC* | B* (wt. ppm) |
|---|---|---|---|---|---|---|---|
| No. 1 | base | 75 | 9 | 13 | 3 | — | 100 |
| No. 2 | 0.2 NbC | 75 | 9 | 13 | 3 | 0.2 | 100 |
| No. 3 | 0.5 NbC | 75 | 9 | 13 | 3 | 0.5 | 100 |
| No. 4 | 1.0 NbC | 75 | 9 | 13 | 3 | 1.0 | 100 |
| No. 5 | 2.5 NbC | 75 | 9 | 13 | 3 | 2.5 | 100 |
| No. 6 | 5.0 NbC | 75 | 9 | 13 | 3 | 5.0 | 100 |

*NbC and B are an extra number; the numbers are not included in the total.

In Table 4, Sample No. 1 containing no NbC is Reference Example 1 (hereinafter, also referred to as base alloy), and Sample Nos. 2 to 6 containing NbC are Examples 1 to 5 of the present invention. For reference, Table 5 shows the contents of the respective elements in the samples in Table 4. (Table 5 shows atomic percentages of the respective elements on the assumption that the sum of Ni, Al, V, Nb and C (excluding B) is 100%. The NbC added is converted on the assumption that one NbC compound is completely decomposed into one Nb atom and one C atom.)

TABLE 5

| | at. % | Ni | Al | V | Nb | C |
|---|---|---|---|---|---|---|
| No. 1 | base | 75.00 | 9.00 | 13.00 | 3.00 | 0.00 |
| No. 2 | 0.2 NbC | 74.70 | 8.96 | 12.95 | 3.19 | 0.20 |
| No. 3 | 0.5 NbC | 74.26 | 8.91 | 12.87 | 3.46 | 0.50 |
| No. 4 | 1.0 NbC | 73.53 | 8.82 | 12.75 | 3.92 | 0.98 |
| No. 5 | 2.5 NbC | 71.43 | 8.57 | 12.38 | 5.24 | 2.38 |
| No. 6 | 5.0 NbC | 68.18 | 8.18 | 11.82 | 7.27 | 4.55 |

(External Observation of Cast Materials)

Figure 1:
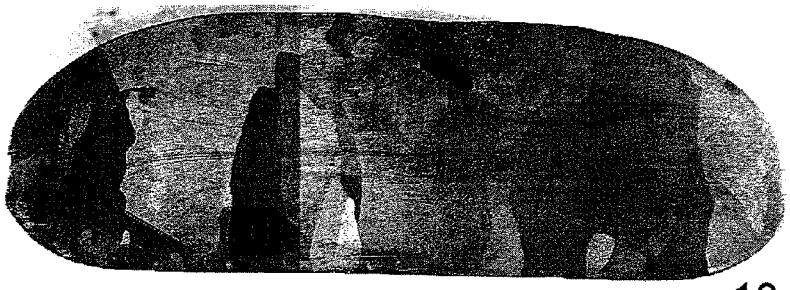
FIGS. 1 (*a*) to (*d*) are optical photomicrographs of cross sections of Sample No. 1 (Reference Example), No. 2, No. 4 and No. 6 (Examples).
Figure 1:
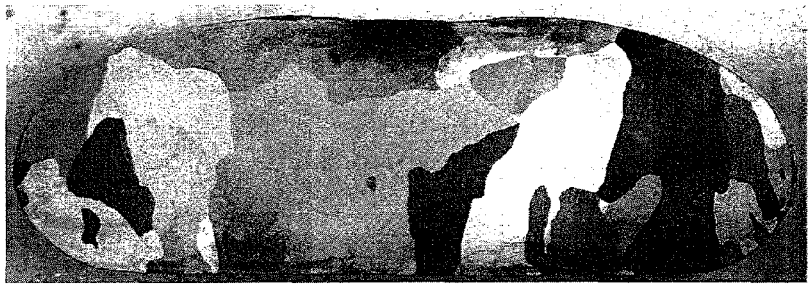
Figure 1:
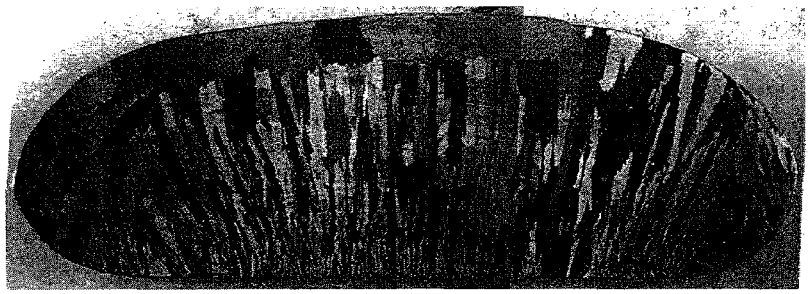
Figure 1:
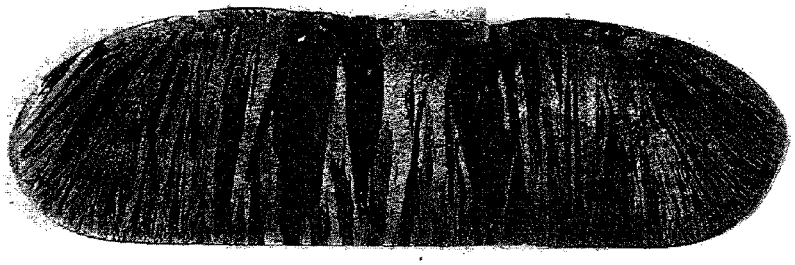

Cross sections of the samples prepared were observed. FIG. 1 shows optical photomicrographs of the cross sections of No. 1, No. 2, No. 4 and No. 6. In FIG. 1, the photographs of (a), (b), (c) and (d) correspond to the photographs of Sample Nos. 1, 2, 4 and 6, respectively.

FIG. 1 shows that crystal grain refinement occurred in No. 2, No. 4 and No. 6. In addition, the observation of the cross sections of Nos. 1 to 6 has revealed that the crystal grain refinement occurred when the amount of NbC added is between 0.2 at. % and 0.5 at. %.

Next, the samples prepared were subjected to the heat treatment in a vacuum at 1553 K for 5 hours as solution heat treatment.

In this experiment, the solution heat treatment serves as the first heat treatment, and the subsequent furnace cooling corresponds to the cooling to the temperature at which the $L1_2$ phase and the $D0_{22}$ phase coexist.

(Microstructure Observation)

Figure 2:
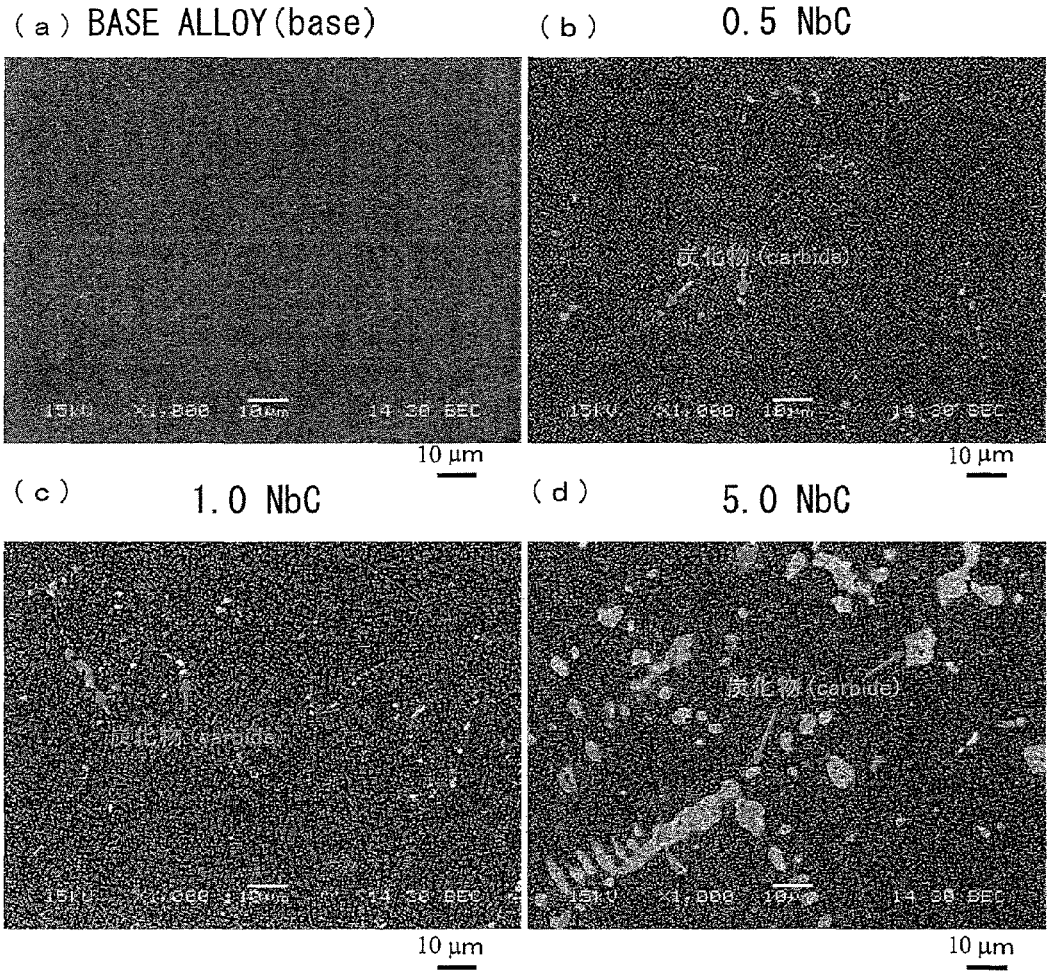
FIGS. 2 (*a*) to (*d*) are SEM photographs (1000 times) of Sample No. 1 (Reference Example), and No. 3, No. 4 and No. 6 (Examples).

Next, microstructure observation by an SEM was performed on the samples after the heat treatment. FIGS. 2 and 3 show photographs obtained. FIG. 2 shows photographs of the microstructures of Sample Nos. 1, 2, 4 and 6 (1000 times), and FIG. 3 shows photographs of the metal microstructures of the parent phases (matrix) in the same samples observed at a higher magnification (5000 times). In FIGS. 2 and 3, the photographs of (a), (b), (c) and (d) correspond to the photographs of Sample of Nos. 1, 2, 4 and 6, respectively.

FIG. 2 shows that second phase particles which are considered carbide exist in Sample Nos. 3, 4 and 6 containing NbC, whereas no second phase particles exist in Sample No. 1 containing no NbC (areas pointed at by arrows in FIG. 2).

FIG. 3 shows that a dual multi-phase microstructure is formed in the parent phases of each sample regardless of whether NbC was added or not. FIG. 3 also shows that a primary precipitate $L1_2$ phase and a eutectoid microstructure are formed in the parent phases of each sample. The results have revealed that the dual multi-phase microstructure can be maintained even when C is introduced into an intermetallic compound through addition of NbC.

(Composition Analysis)

Composition analysis was performed with an EPMA (Electron Probe Micro Analyzer) on the parent phases and the carbide (second phase particles) of each sample after the heat treatment. Tables 6 and 7 show the analysis results. Table 6 shows the result of the composition analysis on the parent phases (matrix) in Sample No. 1, and Table 7 shows the result of the composition analysis on the parent phases (matrix) and the carbide (second phase particles: represented as "Dispersion" in the table) in Sample No. 6. Sample No. 1 is shown for composition comparison with Sample No. 6 in which the carbide (second phase particles) was observed. All the numerical values in Tables 6 and 7 are expressed in atomic % (at. %).

TABLE 6

| | Base | | | | |
|---|---|---|---|---|---|
| | Ni | Al | V | Nb | C |
| Matrix | 74.8 | 8.6 | 12.3 | 3.4 | — |

TABLE 7

| | 5.0 NbC | | | | |
|---|---|---|---|---|---|
| | Ni | Al | V | Nb | C |
| Matrix | 74.1 | 9.4 | 11.3 | 3.8 | 1.42 |
| Carbide | 2.43 | 0.016 | 8.66 | 60.9 | 28.0 |

Tables 6 and 7 indicate that the parent phases of Sample No. 6 have a lower V concentration and a higher C concentration than the parent phases of Sample No. 1. It is also indicated that the carbide (second phase particles) of Sample No. 6 has a higher V concentration as well as higher Nb and C concentrations. It is further indicated that the ratio between the Nb concentration and the C concentration is not 1:1 both in the parent phases and the carbide in Sample No. 6.

These results tell that NbC added was dissolved to form a new microstructure. It has been also revealed that addition of NbC resulted in distribution of C to the parent phases and V to the carbide (second phase particles) to constitute respective solid solutions. Tables 6 and 7 therefore suggest that a dual multi-phase microstructure can be formed even when Nb and C, other than NbC, are separately introduced into a sample.

(Phase Identification)

Next, an X-ray measurement (XRD, X-ray diffraction) was performed on each sample after the heat treatment for identification of the phases in the microstructure. FIGS. 4 to 7 show the measurement results. FIGS. 4 to 7 show X-ray diffraction profiles of Sample Nos. 1, 3, 4 and 6, respectively. The marks in the drawings represent peak positions of $Ni_3Al$ ($L1_2$ phase), $Ni_3V$ ($D0_{22}$ phase) and NbC, which are constituent phases forming the dual multi-phase microstructure. These peak positions are represented by circular dots, triangular dots and quadrangular dots, respectively.

As shown in FIGS. 4 to 7, peaks derived from NbC were observed in No. 3, No. 4 and No. 6. Peaks derived from $Ni_3Al$ ($L1_2$ phase) and $Ni_3V$ ($D0_{22}$ phase) were observed in all of Sample Nos. 1, 3, 4 and 6. These results have revealed that except for the peaks of NbC, no other phases than $Ni_3Al$ ($L1_2$ phase) and $Ni_3V$ ($D0_{22}$ phase), which are the constituent phases of the dual multi-phase microstructure, was formed in all the samples, regardless of whether NbC was added or not. It has been also revealed that the carbide (second phase particles) observed in the microstructure observation is NbC.

(Vickers' Hardness Test)

Next, a Vickers' hardness test was performed on Sample Nos. 1 to 6. In the Vickers' hardness test, a square pyramid diamond indenter was pushed into each sample at room temperature. The load was mainly 300 g, and the retention time was 20 seconds.

Figure 8:
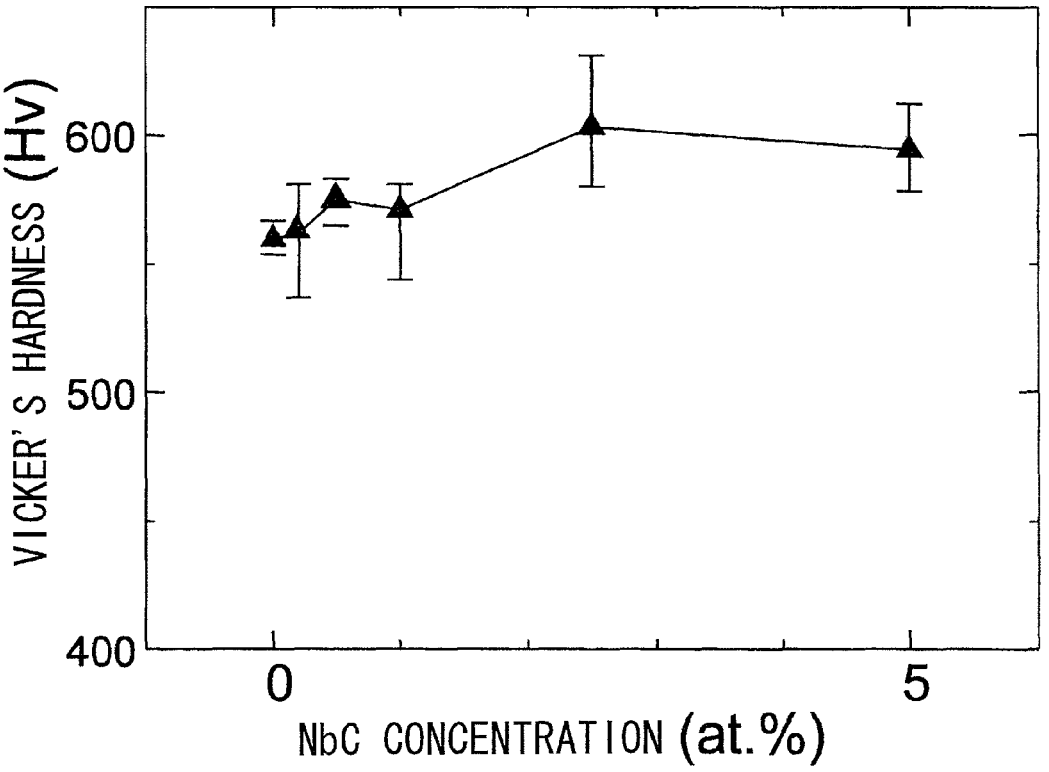
FIG. 8 is a graph showing the relationship between the amount of NbC added and the room-temperature Vickers' hardness of Sample No. 1 (Reference Example) and Nos. 2 to 6 (Examples).

FIG. 8 shows the test results. FIG. 8 is a graph showing the relationship between the amount of NbC added and the Vickers' hardness at room temperature.

FIG. 8 shows that the hardness increases as the amount of NbC added increases. FIG. 8 also shows that the hardness is substantially constant when the amount of NbC is at least 2.5 at. %.

Generally, metals have increased hardness when including impurities. Likewise, this experiment has revealed that addition of NbC leads to increase in the Vickers' hardness.

(Tensile Test)

Next, a tensile test was performed on Sample Nos. 1 to 6. The tensile test was performed in a vacuum in a temperature range from room temperature to 1173 K at a strain rate of $1.67\times10^{-4}$ $s^{-1}$ using a test piece with a gage size of 10×2×1 $mm^3$. FIGS. 9 to 14 show the test results. FIGS. 9 to 14 are graphs showing the relationship of the yield strength, the tensile strength (UTS, ultimate tensile strength) and the elongation versus the temperature for Sample Nos. 1 to 6.

Figure 9:
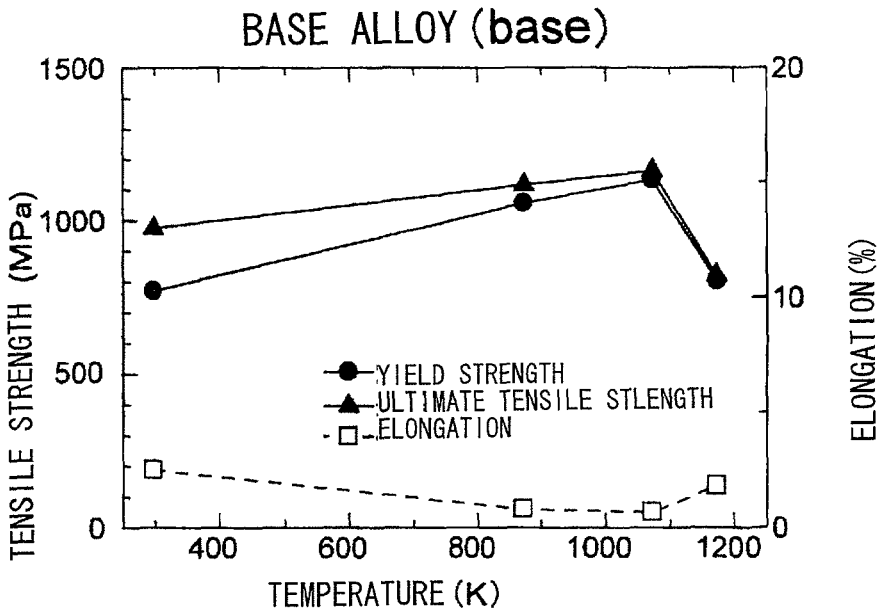
FIG. 9 is a graph showing a result of a measurement of Sample No. 1 (base) (Reference Example) for yield strength, tensile strength and elongation.
Figure 10:
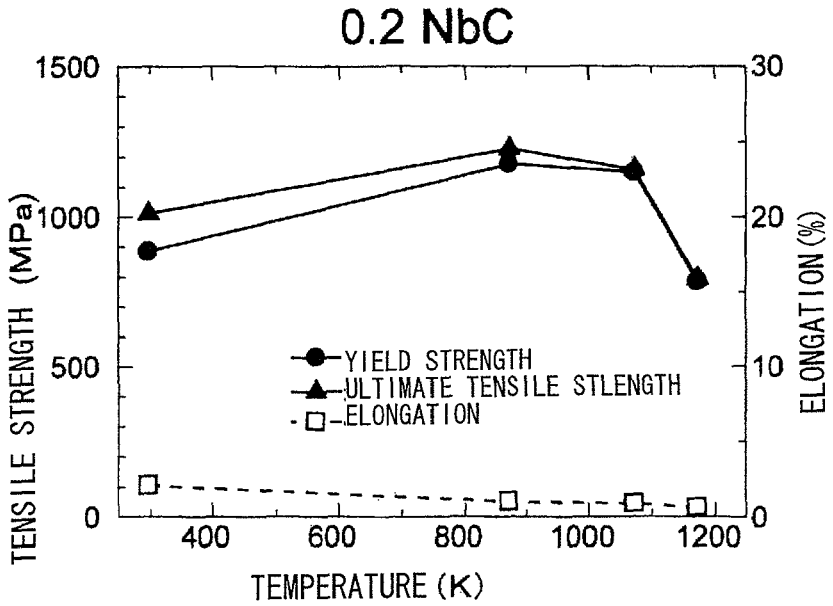
FIG. 10 is a graph showing a result of a measurement of Sample No. 2 (0.2 atomic % NbC) (Example) for yield strength, tensile strength and elongation.
Figure 11:
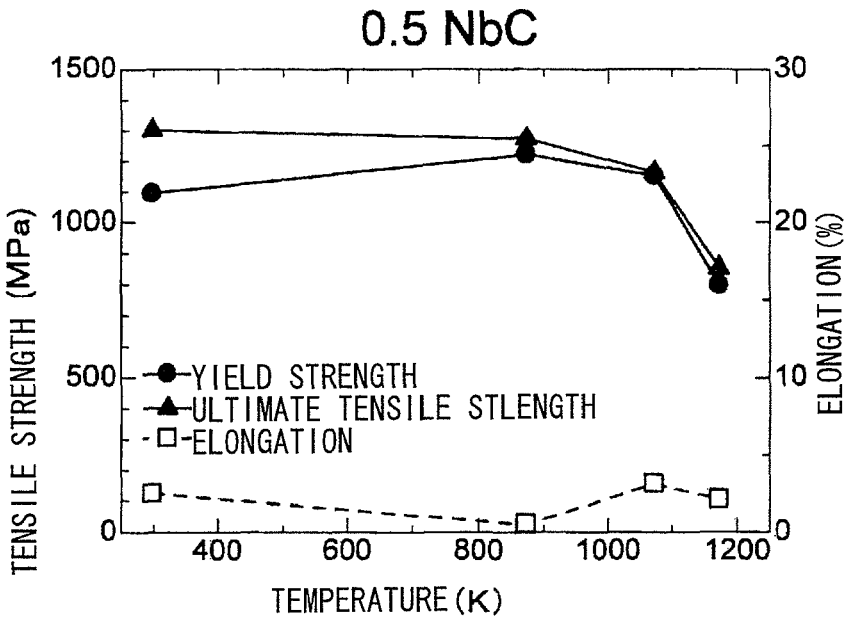
FIG. 11 is a graph showing a result of a measurement of Sample No. 3 (0.5 atomic % NbC) (Example) for yield strength, tensile strength and elongation.
Figure 12:
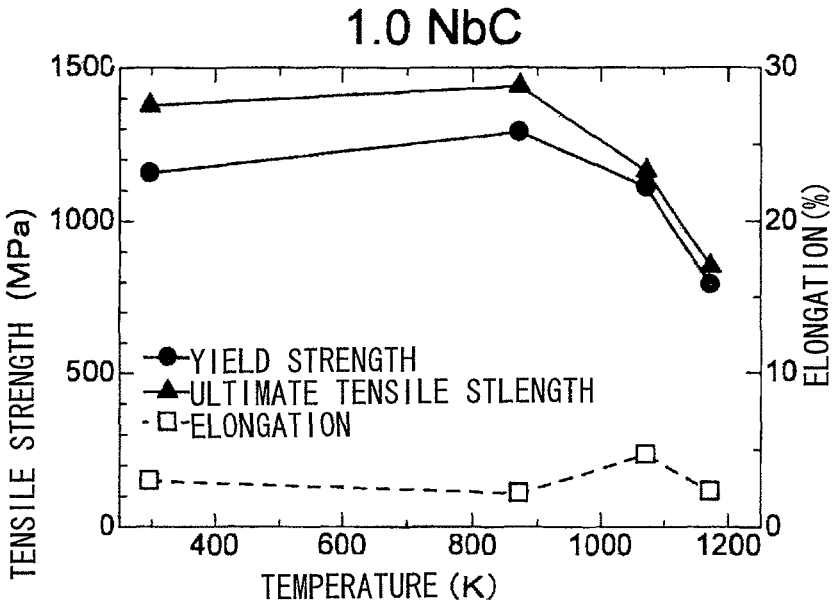
FIG. 12 is a graph showing a result of a measurement of Sample No. 4 (1.0 atomic % NbC) (Example) for yield strength, tensile strength and elongation.
Figure 13:
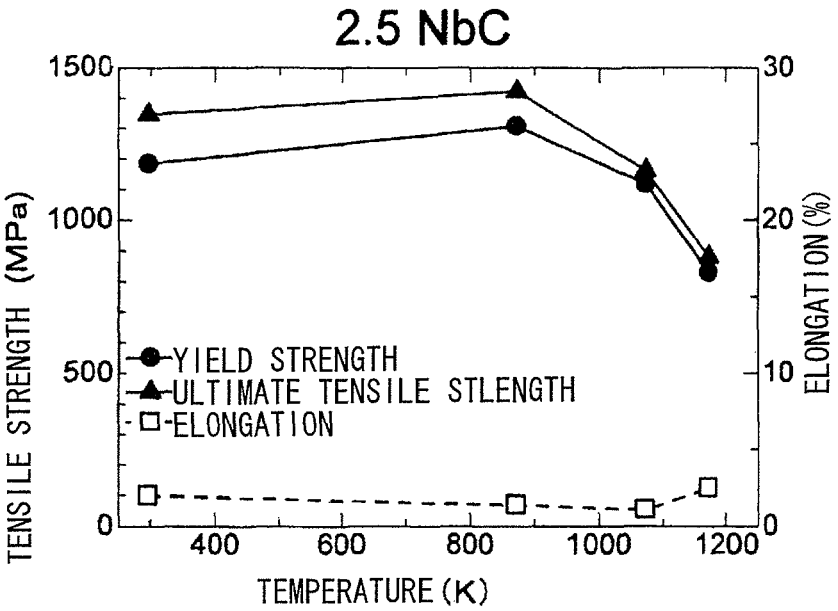
FIG. 13 is a graph showing a result of a measurement of Sample No. 5 (2.5 atomic % NbC) (Example) for yield strength, tensile strength and elongation.
Figure 14:
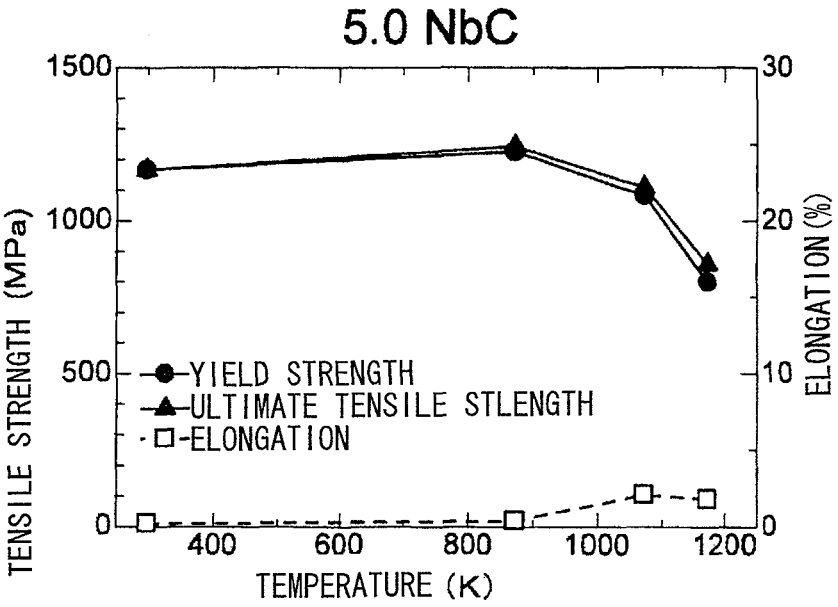
FIG. 14 is a graph showing a result of a measurement of Sample No. 6 (5.0 atomic % NbC) (Example) for yield strength, tensile strength and elongation.

FIGS. 9 to 14 indicate that the strength of the sample (No. 1) containing no NbC shows inverse temperature dependency up to approximately 1073 K (FIG. 9). That is, the value of the tensile strength increases with increase in temperature. Likewise, the graphs indicate that the strength of the samples (Nos. 2 to 6) containing NbC also shows inverse temperature dependency up to 873 K (FIGS. 10 to 14). It is also indicated that the samples show elongations of 0.3% to 4.7% in the range of all the temperatures from room temperature to high temperature regardless of whether NbC was added or not.

Next, FIGS. 15 to 18 show the relationship of the yield strength, the tensile strength and the elongation versus the amount of NbC added. FIGS. 15 to 18 are graphs for analysis of results of the tensile test on Sample Nos. 1 to 6.

Figure 15:
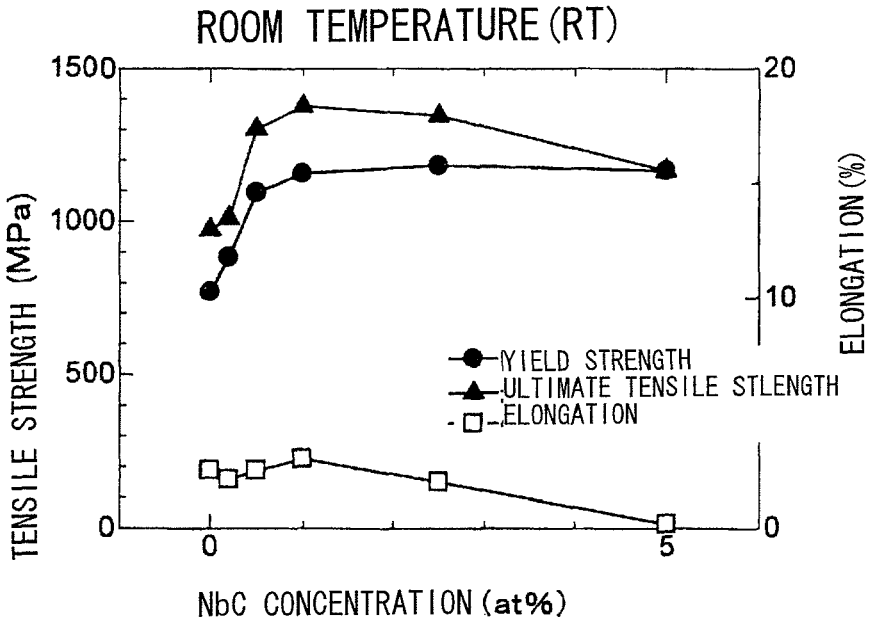
FIG. 15 is a graph showing the relationship of the yield strength, the tensile strength and the elongation versus the NbC concentration for Sample No. 1 (Reference Example) and Nos. 2 to 6 (Examples) at room temperature (RT).

FIG. 15 indicates that, at room temperature (RT), all the characteristic values of the yield strength, the tensile strength and the elongation increase with increase in the amount of NbC added, and they reach maximums when the amount of NbC added is approximately 1 atomic %. In particular, the tensile strength exceeds 1.3 GPa when the amount of NbC added is approximately 1 atomic %, and the strength property is excellent when the amount of NbC added is at least 0.2 atomic % and less than 2.5 atomic %. The values of the yield strength, the tensile strength and the elongation tend to decrease with increase in the amount of NbC added once the amount of NbC added exceeds 1 atomic %. Still, it is indicated that the values of the yield strength and the tensile strength are comparable or superior to those of the sample containing no NbC (No. 1).

Figure 16:
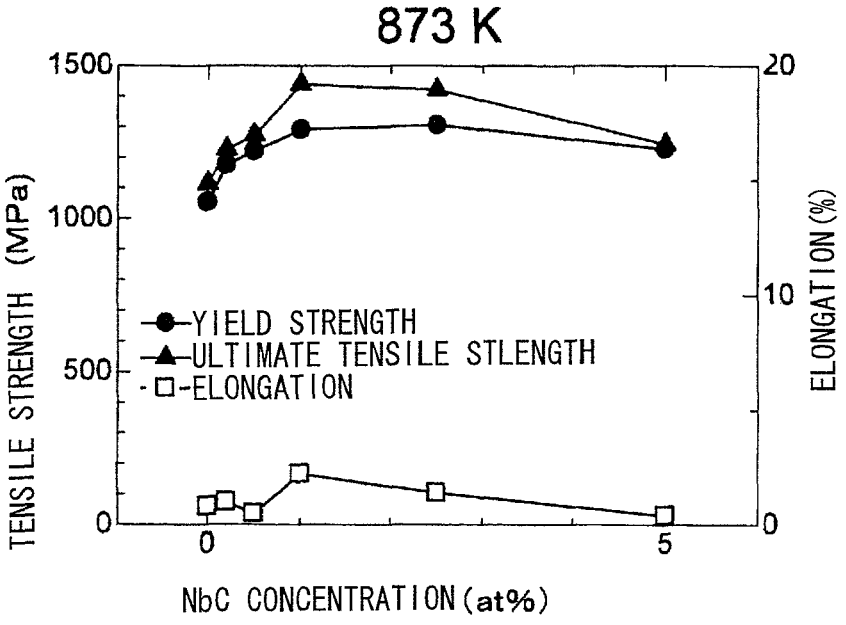
FIG. 16 is a graph showing the relationship of the yield strength, the tensile strength and the elongation versus the NbC concentration for Sample No. 1 (Reference Example) and Nos. 2 to 6 (Examples) at 873 K.

Likewise, FIG. 16 indicates that, at 873 K as in the case of room temperature, all the values of the yield strength, the tensile strength and the elongation increase with increase in the amount of NbC added, and they reach maximums when the amount of NbC added is approximately 1 atomic %. It is also indicated that the characteristic values slightly decrease or stay substantially constant once the amount of NbC added exceeds 1 atomic %. In particular, the strength characteristics are excellent when the amount of NbC added is at least 0.2 atomic % and less than 2.5 atomic %. The yield strength and the tensile strength are still superior to those of the sample containing no NbC even when the amount of NbC added exceeds 1 atomic %.

Figure 17:
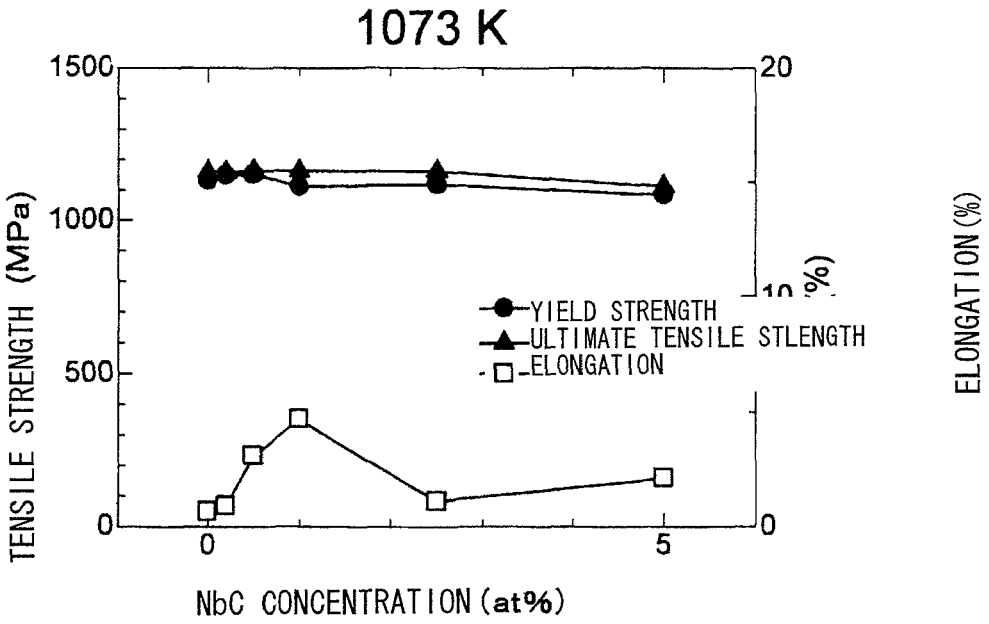
FIG. 17 is a graph showing the relationship of the yield strength, the tensile strength and the elongation versus the NbC concentration for Sample No. 1 (Reference Example) and Nos. 2 to 6 (Examples) at 1073 K.
Figure 18:
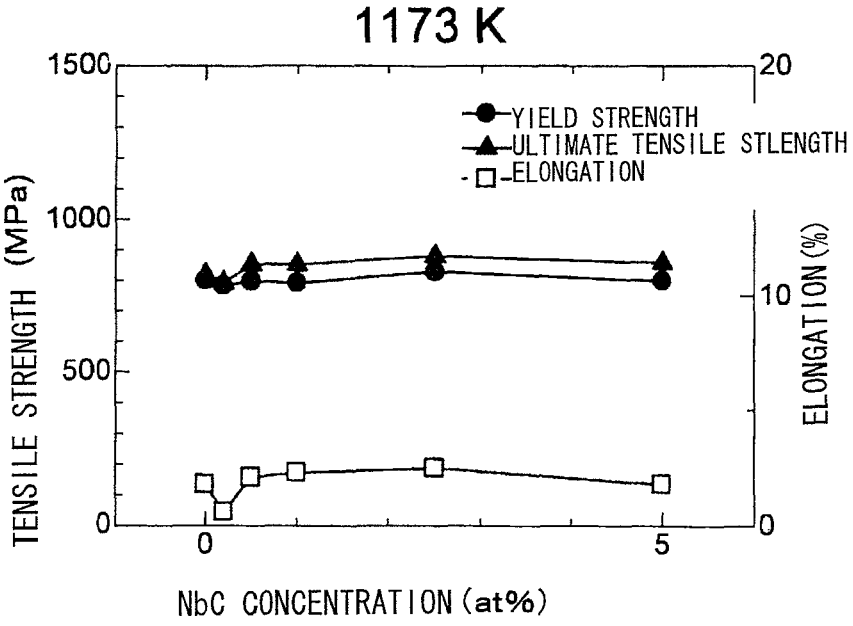
FIG. 18 is a graph showing the relationship of the yield strength, the tensile strength and the elongation versus the NbC concentration for Sample No. 1 (Reference Example) and Nos. 2 to 6 (Examples) at 1173 K.

Furthermore, FIG. 17 indicates that the elongation increases with increase in the amount of NbC added. In addition, FIGS. 17 and 18 indicate that the values of the yield strength and the tensile strength stay substantially constant.

These results have revealed that addition of NbC resulted in enhancement of the strength (yield strength and tensile strength) of the samples at room temperature. In particular, it has been revealed that the enhancement is significant when the amount of NbC added is less than 2.5 atomic %. It has been also revealed that the ductility (elongation) is best enhanced when the amount of NbC added is 1.0 atomic % (room temperature to 1073 K).

This is considered because C obtained through decomposition of NbC became a solid solution in the parent phases, causing solid solution strengthening, and the solid solution strengthening was effective in the low temperature range. The enhancement of the strength due to the addition of NbC is therefore significant when the temperature is from room temperature to 873 K.

Since the amount of C that can become a solid solution is limited (solid solubility limit), it is considered that the strength is enhanced with increase in the amount of NbC added until the amount of C reached the solubility limit, and the enhancement of the strength stops once the amount of C reached the solubility limit. This is considered a reason why the strength reaches a maximum when the amount of NbC added is approximately 1%.

Figure 19:
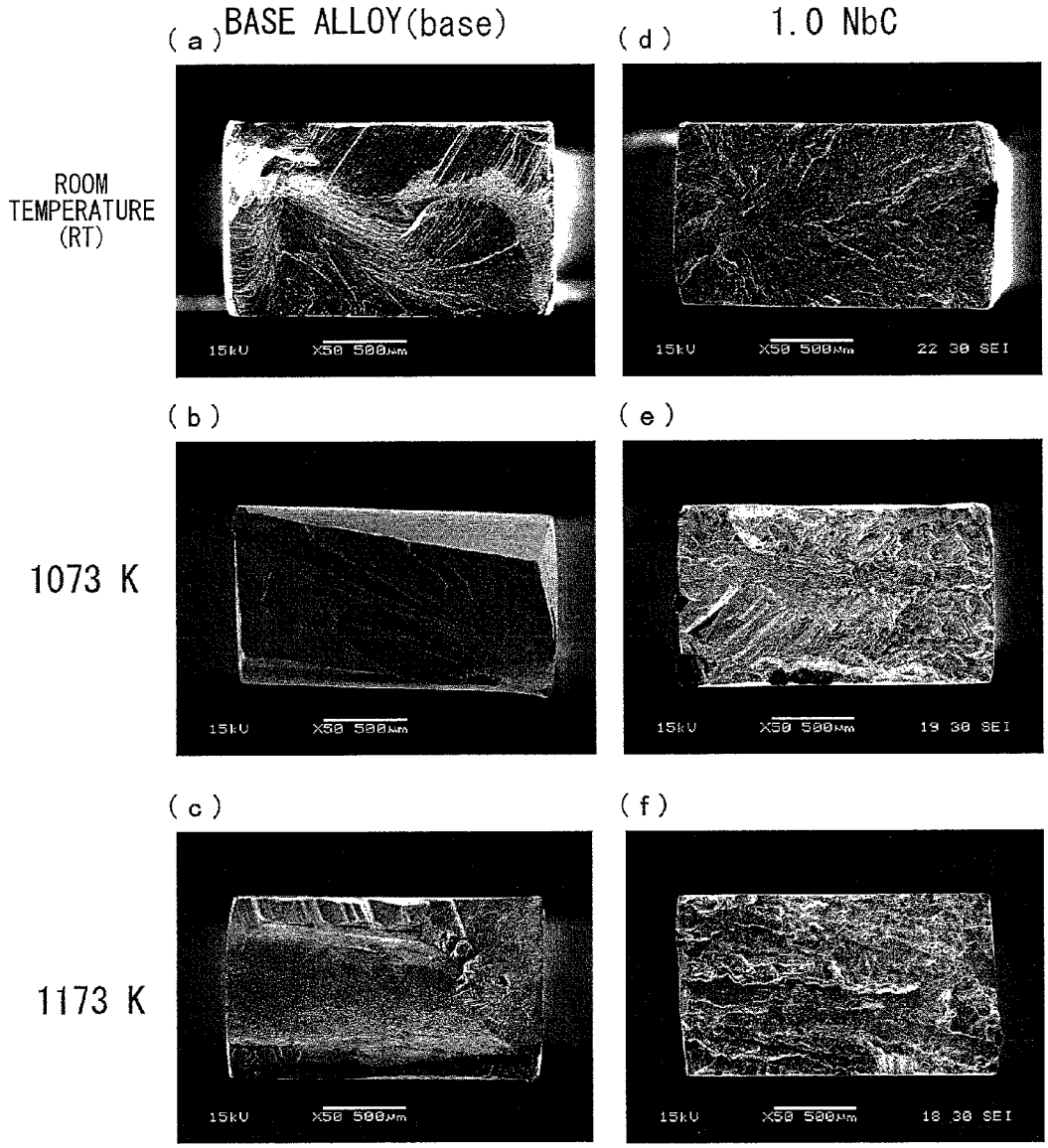
FIGS. 19 (*a*) to (*f*) are SEM photographs of fracture surfaces of No. 1 (Reference Example) and No. 4 (Example) after a tensile test.
Figure 20:
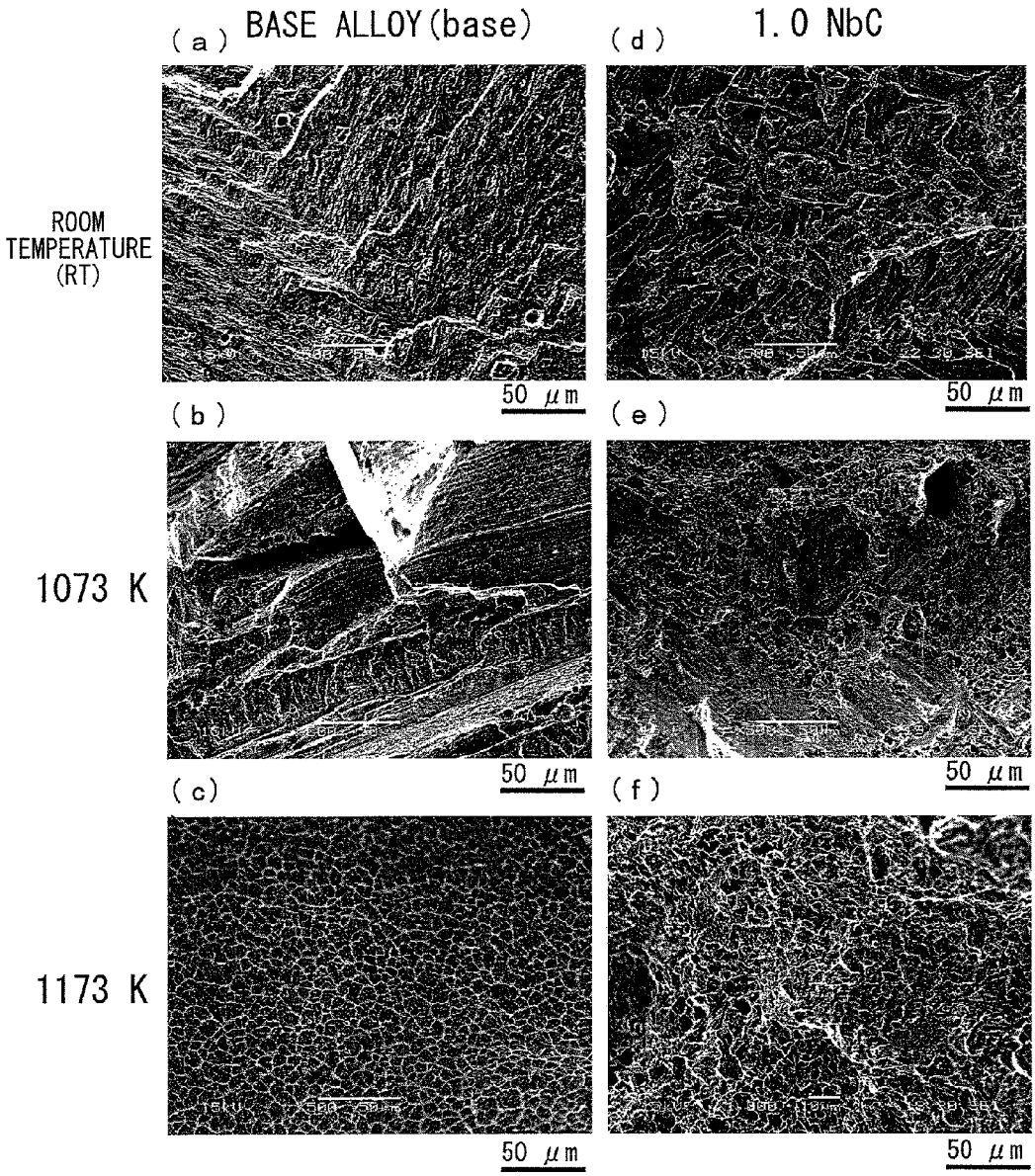
FIGS. 20 (*a*) to (*f*) are magnified SEM photographs of the fracture surfaces of No. 1 (Reference Example) and No. 4 (Example) after the tensile test.
Figure 21:
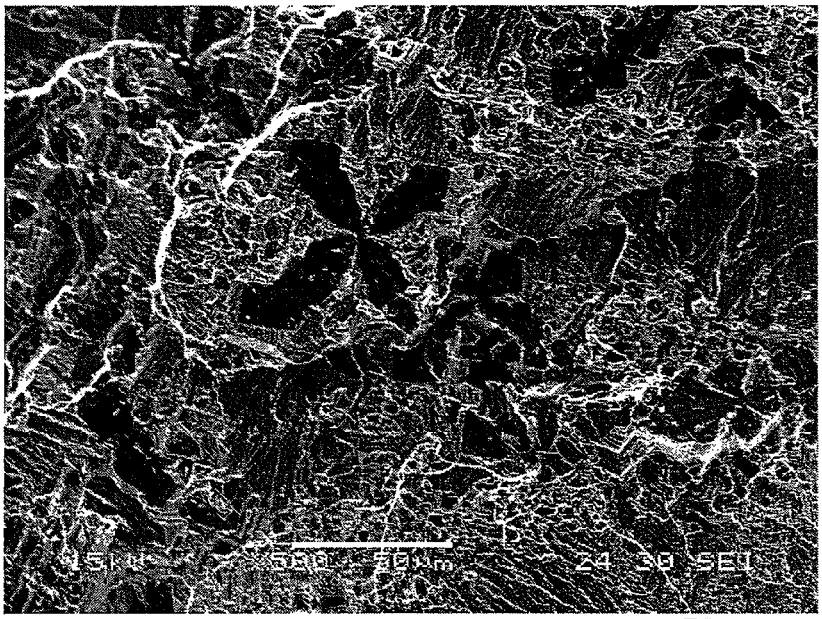
FIGS. 21 (*a*) and (*b*) are SEM photographs of the fracture surfaces of Sample No. 6 (5.0 atomic % NbC) (Example) after the tensile test.
Figure 21:
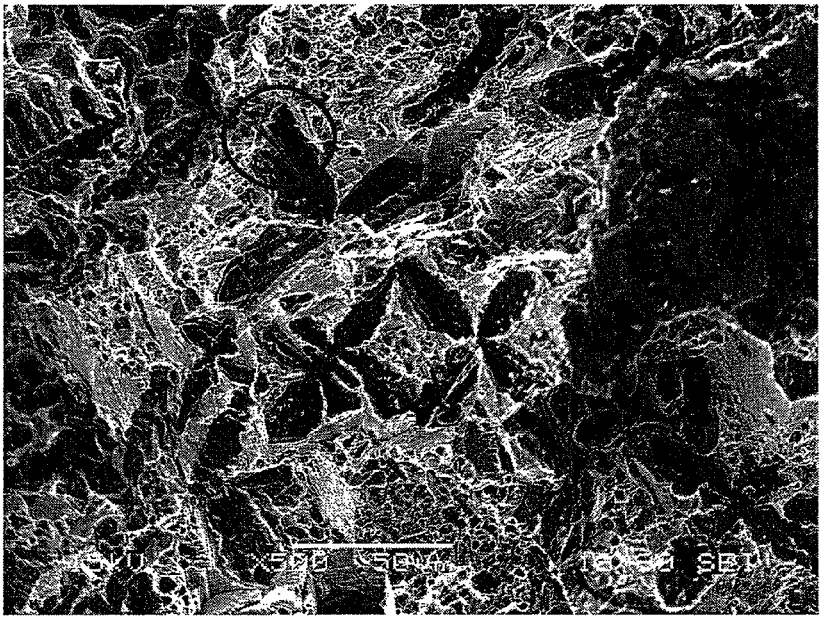

Next, fracture surface observation was performed on each sample after the tensile test. FIGS. 19, 20 and 21 show fracture surfaces of some of the samples. FIG. 19 shows SEM photographs (low-magnification photographs) of the fracture surfaces of Sample Nos. 1 and 4 after the tensile test at room temperature (RT), 1073 K and 1173 K, respectively. FIG. 20 shows magnified SEM photographs (high-magnification photographs) of the fracture surfaces of the samples in FIG. 19. In these drawings, (a), (b) and (c) show the fracture surfaces of Sample No. 1, and (d), (e) and (f) show the fracture surfaces of Sample No. 4. FIG. 21 shows magnified SEM photographs of the fracture surfaces of No. 6. (a) shows the fracture surface after the tensile test at room temperature, and (b) shows the fracture surface after the tensile test at 1073 K.

As shown in FIGS. 19 and 20, Sample No. 1 takes on an aspect of quasi-cleavage fracture at room temperature and increases the tendency of intergranular fracture with increase in temperature. The intergranular fracture completely dominated at 1173 K ((a), (b) and (c) in FIGS. 19 and 20).

On the other hand, ductile transgranular fracture was observed in Sample No. 4 in a temperature range from room temperature to high temperature (1173 K). In addition, fracture mode having a dimple pattern was observed around the carbide (second phase particles) ((d), (e) and (f) in FIGS. 19 and 20).

As shown in FIG. 21, in the sample containing a larger amount of carbide, the carbide was coarsened and thereby the cracking was caused (circled area in FIG. 21).

These results suggest that addition of NbC leads to inhibition of intergranular fracture, thereby causing transgranular fracture. Accordingly, the ductility is improved. In addition, observation of the carbide has revealed that carbon contributes to the ductility when added in an appropriate amount.

Examples 6 to 11

Next, other samples were prepared as Reference Example 2 and Examples 6 to 11, and examined for the mechanical properties.

Cast materials of Reference Example 2 and Examples 6 to 11 were prepared in the same manner as in Sample Nos. 1 to 6 except for the composition of the raw metal materials. That is, instead of using NbC powders as a material, raw metals of Ni, Al, V and Nb (each having a purity of 99.9% by weight), and C and B powders in the proportions shown as No. 7 to No. 13 in Table 8 were used as the materials. These materials were melted and casted in a mold in an arc melting furnace to prepare the cast materials. The atmosphere in the arc melting furnace was the same as in the preparation of Sample Nos. 1 to 6, and the electrodes and the mold were also the same as in the preparation of Sample Nos. 1 to 6.

In Table 8, Sample No. 7 containing no C is Reference Example 2 (hereinafter, also referred to as base alloy), and Sample Nos. 8 to 13 containing C are Examples 6 to 11 of the present invention.

In Table 8, the numerical values for B and C are atomic percentages relative to a composition of 100 at. % in total containing Ni, Al, V and Nb. C is expressed also in ppm by weight for reference in addition to atomic %.

TABLE 8

| | | Ni | Al | V | Nb | C | | B |
|---|---|---|---|---|---|---|---|---|
| | alloy | (at. %) | (at. %) | (at. %) | (at. %) | (at. %) | (wt. ppm) | (wt. ppm) |
| No. 7 | 0C—Nb(base) | 75 | 9 | 13 | 3 | | — | 100 |
| No. 8 | 0.1C—Nb | 75 | 9 | 13 | 3 | 0.1 | (0.021) | 100 |
| No. 9 | 0.3C—Nb | 75 | 9 | 13 | 3 | 0.3 | (0.064) | 100 |
| No. 10 | 0.5C—Nb | 75 | 9 | 13 | 3 | 0.5 | (0.107) | 100 |
| No. 11 | 1.0C—Nb | 75 | 9 | 13 | 3 | 1.0 | (0.215) | 100 |
| No. 12 | 2.0C—Nb | 75 | 9 | 13 | 3 | 2.0 | (0.428) | 100 |
| No. 13 | 4.0C—Nb | 75 | 9 | 13 | 3 | 4.0 | (0.853) | 100 |

Next, as in the case of Sample Nos. 1 to 6, the cast materials prepared were subjected to the heat treatment in a vacuum at 1553 K for 3 hours as solution heat treatment to prepare Sample Nos. 7 to 13. (As in the case of Examples 1 to 5, the solution heat treatment serves as the first heat treatment, and the subsequent furnace cooling corresponds to the cooling to the temperature at which the $L1_2$ phase and the $D0_{22}$ phase coexist.)

(Microstructure Observation)

Figure 22:
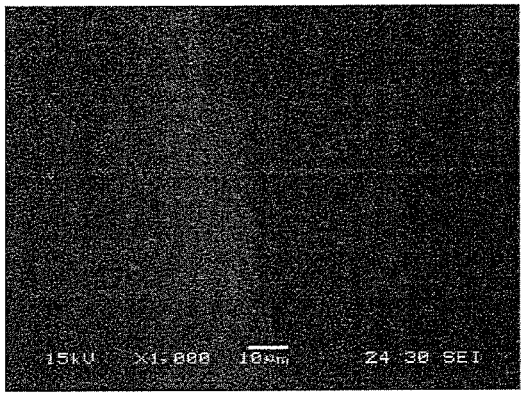
FIGS. 22 (*a*) to (*d*) are SEM photographs (1000 times) of Sample No. 7 (Reference Example) and Nos. 8 to 10 (Examples).
Figure 22:
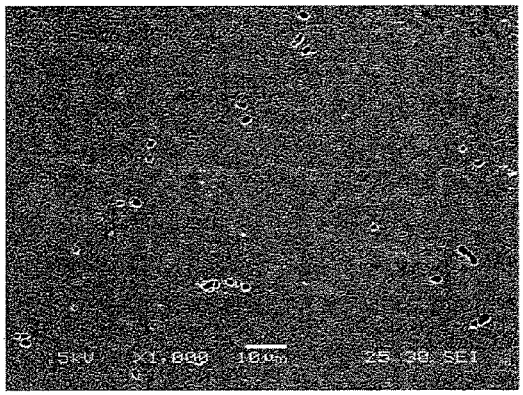
Figure 22:
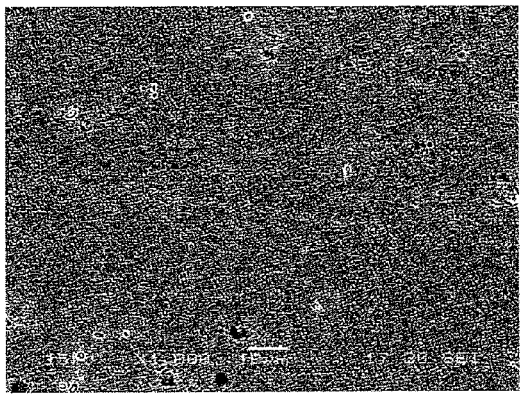
Figure 22:
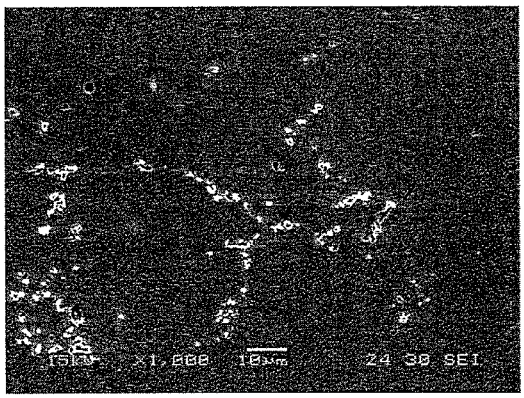
Figure 23:
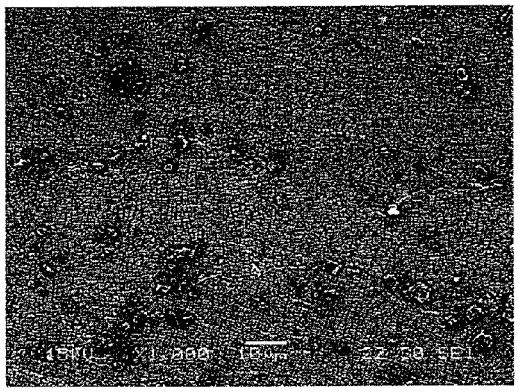
FIGS. 23 (*e*) to (*g*) are SEM photographs (1000 times) of Sample Nos. 11 to 13 (Examples).
Figure 23:
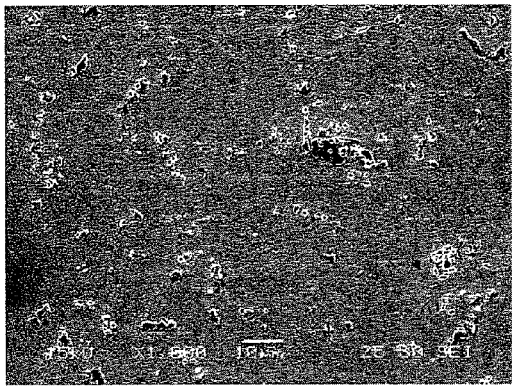
Figure 23:
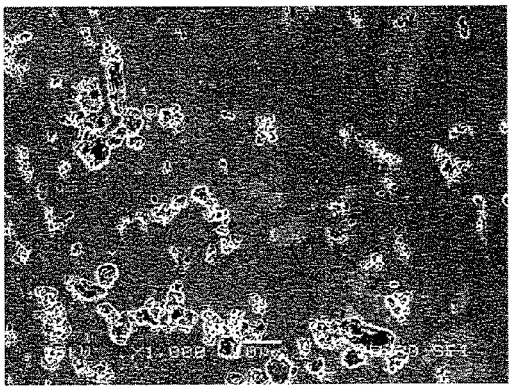
Figure 24:
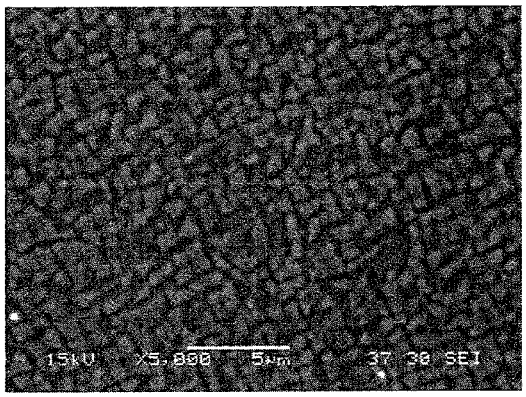
FIGS. 24 (*a*) to (*d*) are SEM photographs (5000 times) of Sample No. 7 (Reference Example) and Nos. 8 to 10 (Examples).
Figure 24:
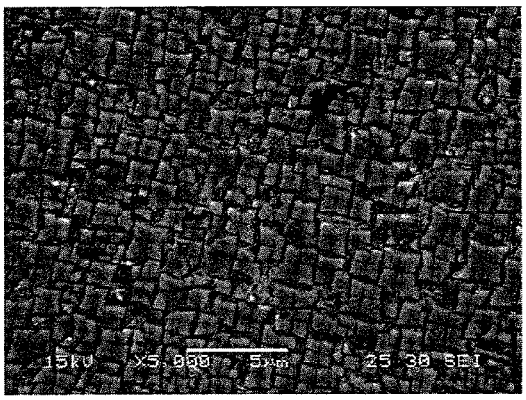
Figure 24:
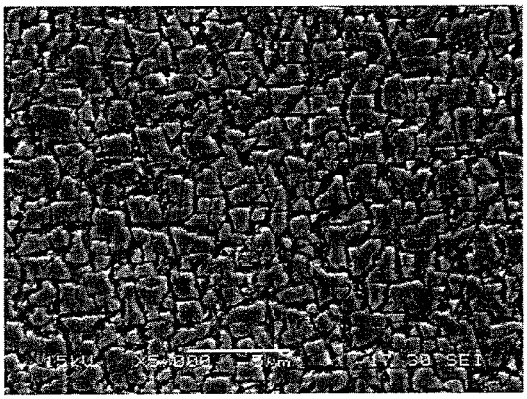
Figure 24:
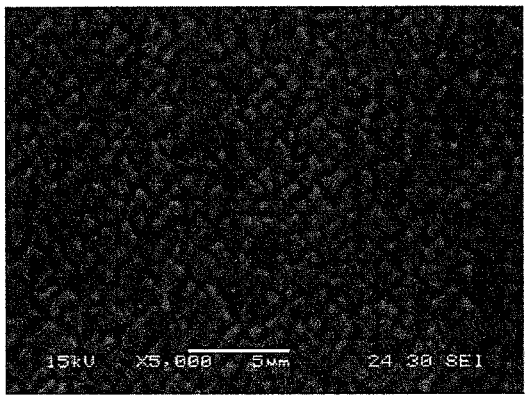
Figure 25:
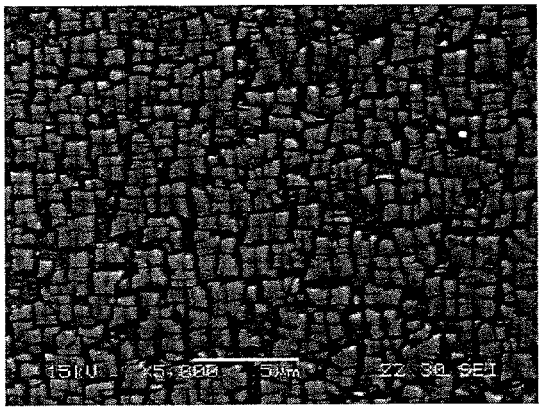
FIGS. 25 (*e*) to (*g*) are SEM photographs (5000 times) of Sample Nos. 11 to 13 (Examples).
Figure 25:
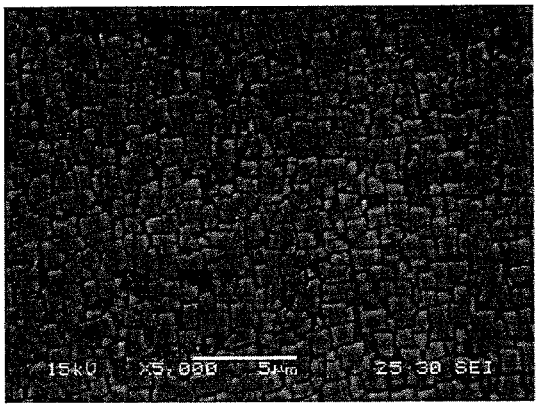
Figure 25:
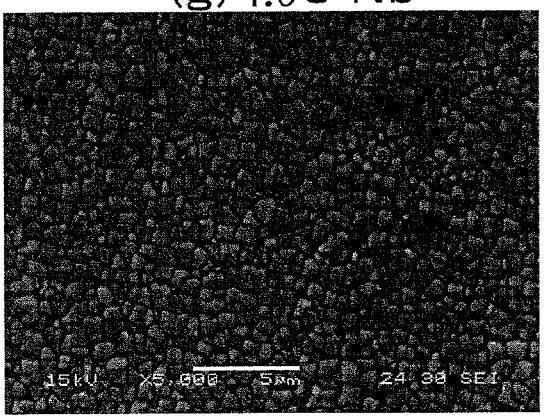

Next, microstructure observation by an SEM was performed on Sample Nos. 7 to 13 prepared. FIGS. 22 to 25 show the photographs. FIGS. 22 to 25 show the SEM photographs of Sample Nos. 7 to 13, among which FIGS. 22 and 23 show low-magnification photographs (1000 times), and FIGS. 24 and 25 show high-magnification photographs (5000 times) of the parent phases (matrix) of the same samples. In FIGS. 22 to 25, (a) corresponds to No. 7, (b) corresponds to No. 8, (c) corresponds to No. 9, (d) corresponds to No. 10, (e) corresponds to No. 11, (f) corresponds to No. 12, and (g) corresponds to No. 13.

FIGS. 22 and 23 show that the second phase particles, which are considered the carbide, exist in Sample Nos. 8 to 13 containing at least 0.1 at. % of C, and the second phase particles do not exist in Sample No. 7. The result has reveled that the second phase particles are formed when C is at least 0.1 at. % under the conditions that the amount of C to be added is increased while fixing the amount of Nb to be added.

In addition, FIGS. 24 and 25 indicate that the dual multi-phase microstructure is formed regardless of whether C was added or not and of the amount of C added. That is, it is revealed that a primary precipitate $L1_2$ phase and a eutectoid microstructure are formed in the parent phases of each sample. The microstructure observation has revealed that the dual multi-phase microstructure is maintained even when Nb and C are separately introduced into each intermetallic compound (even when the amount of C to be added is increased while fixing the amount of Nb to be added) as in the cases of the addition of NbC (the cases of Sample Nos. 1 to 6).

(Composition Analysis)

In addition, the parent phase compositions of Sample Nos. 7 and 13 were analyzed with an EPMA. Table 9 shows the analysis results. Table 9 shows the results of the composition analysis on Sample Nos. 7 and 13. All the numerical values in Table 8 are expressed in atomic % (at. %).

TABLE 9

| | No. 7 0C—Nb (base) | No. 13 4.0C—Nb parent phase |
|---|---|---|
| Ni | 75.47 | 77.51 |
| Al | 9.10 | 9.67 |
| V | 11.63 | 10.00 |
| Nb | 3.80 | 1.91 |
| C | — | 0.90 |

Table 9 shows that the parent phases of Sample No. 13 have almost the same composition as the parent phases of Sample No. 7 except for the V concentration, which is lower than that of Sample No. 7. The result indicates that the parent phases formed have almost the same concentrations. The carbide (second phase particles) of No. 13 was analyzed with an EPMA, and the analysis result has revealed that V and Nb are forming the carbide (structure containing V, Nb and C as main components) (not shown in the table because the carbide was too fine to give accurate analysis result).

(Tensile Test)

Next, a tensile test was performed on Sample Nos. 7 to 13. The tensile test was performed in a vacuum in a temperature range from room temperature to 1173 K at a strain rate of $1.67\times10^{-4}$ $s^{-1}$ using a test piece with a gage size of 10×2×1 $mm^3$. FIGS. 26 to 29 show the test results. FIGS. 26 to 29 are graphs showing the relationship of the yield strength, the tensile strength (UTS, ultimate tensile strength) and the elongation versus the C concentration for Sample Nos. 7 to 13. As for the testing temperature, FIG. 26 corresponds to room temperature (RT), FIG. 27 corresponds to 873 K, FIG. 28 corresponds to 1073 K, and FIG. 29 corresponds to 1173 K.

Figure 26:
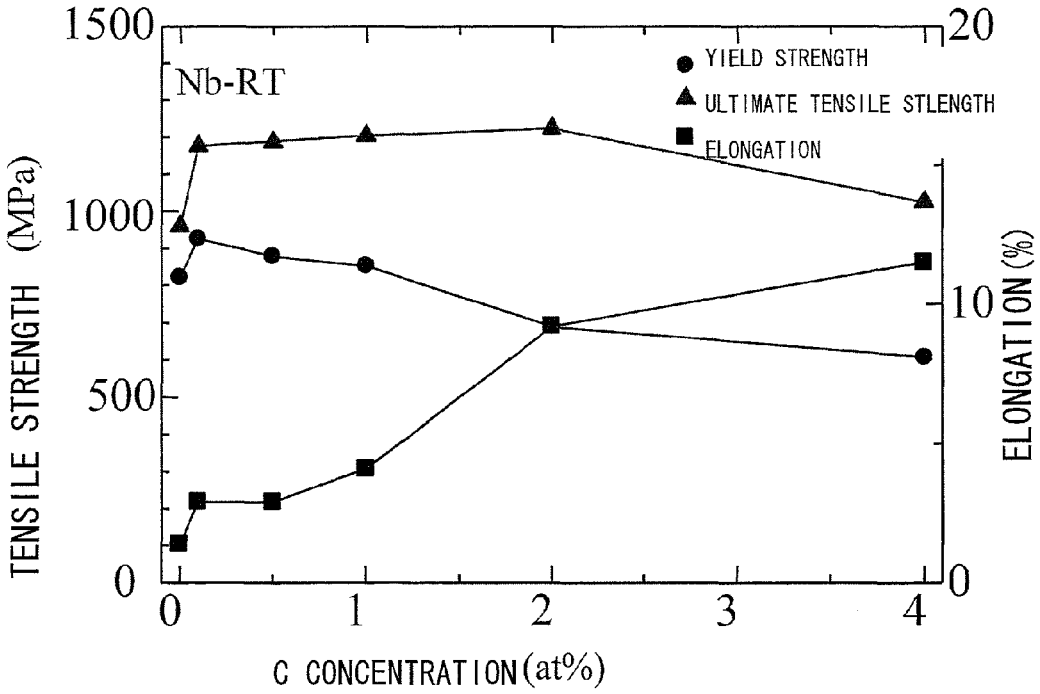
FIG. 26 is a graph showing the relationship of the yield strength, the tensile strength and the elongation versus the C concentration for Sample No. 7 (Reference Example) and Nos. 8 to 13 (Examples) at room temperature (RT).

FIG. 26 indicates that at room temperature (RT), the characteristic values of the tensile strength and the elongation tend to increase with increase in the amount of C added. It is also indicated that the tensile strength, the yield strength and the elongation all increase when the amount of C added is 0.1 atomic %. In particular, improvement of the elongation by the addition of C is significant.

Figure 27:
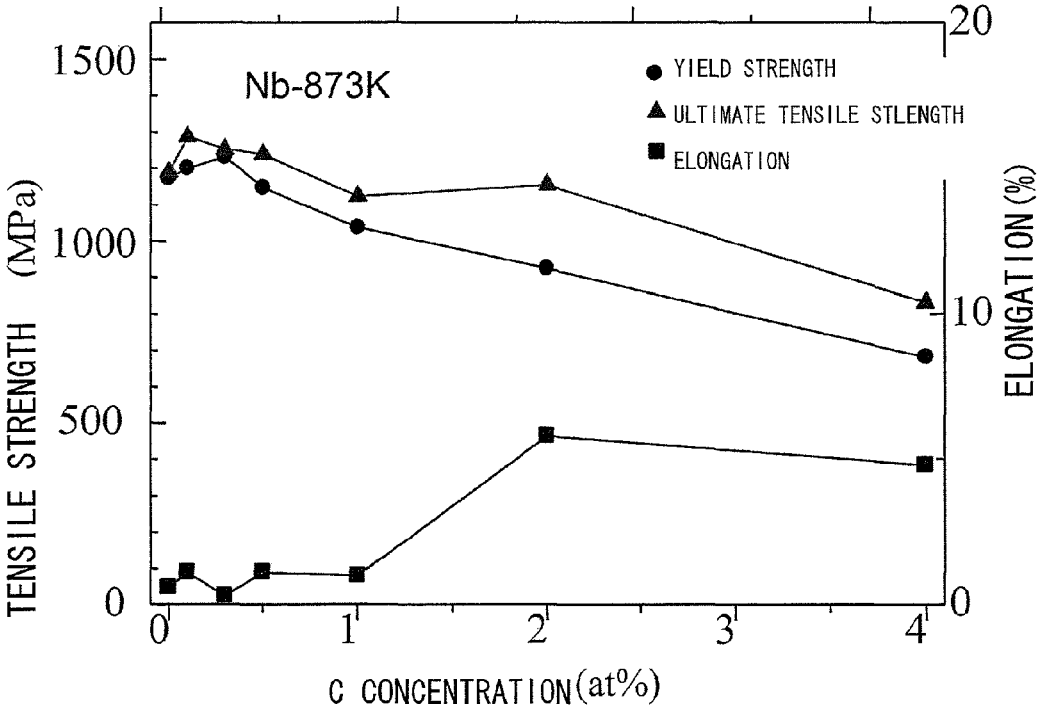
FIG. 27 is a graph showing the relationship of the yield strength, the tensile strength and the elongation versus the C concentration for Sample No. 7 (Reference Example) and Nos. 8 to 13 (Examples) at 873 K.

FIG. 27 indicates that even at 873 K, the characteristic value of the elongation tends to increase with increase in the amount of C added. It is indicated that the addition of C even in an amount of 0.1 atomic % was effective and that the characteristics were more significantly improved than those of the sample not containing C when the amount of C added was more than 2.0 atomic %.

Figure 28:
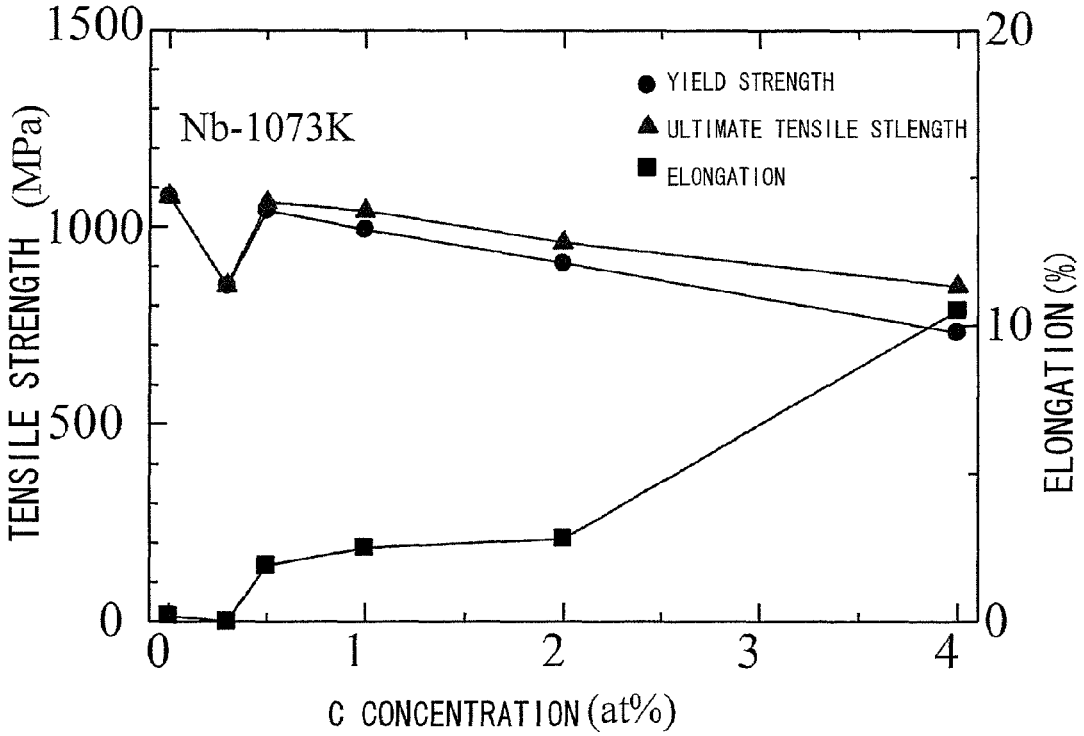
FIG. 28 is a graph showing the relationship of the yield strength, the tensile strength and the elongation versus the C concentration for Sample No. 7 (Reference Example) and Nos. 8 to 13 (Examples) at 1073 K.
Figure 29:
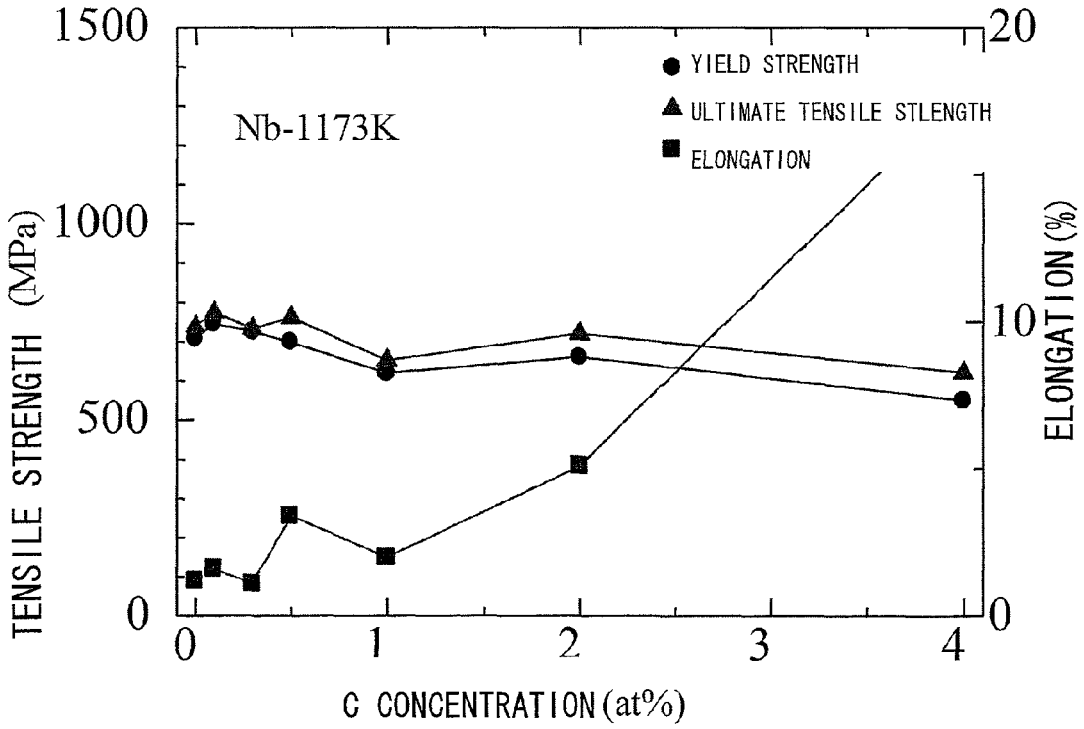
FIG. 29 is a graph showing the relationship of the yield strength, the tensile strength and the elongation versus the C concentration for Sample No. 7 (Reference Example) and Nos. 8 to 13 (Examples) at 1173 K.

Furthermore, FIGS. 28 and 29 indicate that the similar tendency takes place at 1073 K and 1173 K. That is, even at 1073 K and 1173 K, the characteristic values of the elongation tend to increase with increase in the amount of C added.

As described above, it is revealed that the strength (tensile strength) and the elongation of the samples were enhanced by the addition of C to the base composition in a wide temperature range from room temperature to high temperature.

Examples 12 to 16

Further, the same experiment as the experiment of Examples 1 to 5 was performed with 75 at. % of Ni, 9 at. % of Al, 13 at. % of V, 3 at. % of Nb, from 0 to 5.0 at. % of TiC and 100 ppm by weight of B (the TiC content is a value relative to Ni, Al, V and Nb totaling 100 atomic %). In this experiment, C was added as TiC instead of NbC, and Nb was added separately. Hereinafter, the results will be described as Examples 12 to 16.

Cast materials of Reference Example 3 and Examples 12 to 16 were prepared by melting and casting raw metals of Ni, Al, V and Nb (each having a purity of 99.9% by weight), and B and TiC powders (having a particle size of approximately 1 to 3 μm) in the proportions shown as No. 14 to No. 19 in Table 10 in a mold in an arc melting furnace. The atmosphere in the arc melting furnace, the electrodes and the mold were the same as in Examples 1 to 5. The numerical values in Table 10 are expressed in the same manner as in Table 4. As in the case of Table 5 relative to Table 4, Table 11 shows atomic percentages of the respective elements on the assumption that the sum of Ni, Al, V, Nb, Ti and C (excluding B) becomes 100 atomic %.

TABLE 10

| | alloy | Ni | Al | V | Nb | Ti C | B (wt. ppm) |
|---|---|---|---|---|---|---|---|
| No. 14 | base | 75 | 9 | 13 | 3 | — | 100 |
| No. 15 | 0.2Ti C | 75 | 9 | 13 | 3 | 0.2 | 100 |
| No. 16 | 0.5Ti C | 75 | 9 | 13 | 3 | 0.5 | 100 |
| No. 17 | 1.0Ti C | 75 | 9 | 13 | 3 | 1.0 | 100 |
| No. 18 | 2.5Ti C | 75 | 9 | 13 | 3 | 2.5 | 100 |
| No. 19 | 5.0Ti C | 75 | 9 | 13 | 3 | 5.0 | 100 |

TABLE 11

| at. % | | Ni | Al | V | Nb | Ti | C |
|---|---|---|---|---|---|---|---|
| No. 14 | base | 75.00 | 9.00 | 13.00 | 3.00 | 0.00 | 0.00 |
| No. 15 | 0.2Ti C | 74.70 | 8.96 | 12.95 | 2.99 | 0.20 | 0.20 |
| No. 16 | 0.5Ti C | 74.25 | 8.91 | 12.87 | 2.97 | 0.50 | 0.50 |
| No. 17 | 1.0Ti C | 73.53 | 8.82 | 12.75 | 2.94 | 0.98 | 0.98 |
| No. 18 | 2.5Ti C | 71.43 | 8.57 | 12.38 | 2.86 | 2.38 | 2.38 |
| No. 19 | 5.0Ti C | 68.18 | 8.18 | 11.82 | 2.72 | 4.55 | 4.55 |

In Tables 10 and 11, Sample No. 14 containing no TiC is Reference Example 3 (hereinafter, also referred to as base alloy), and Sample Nos. 15 to 19 containing TiC are Examples 12 to 16 of the present invention.

(External Observation of Cast Materials)

Figure 30:
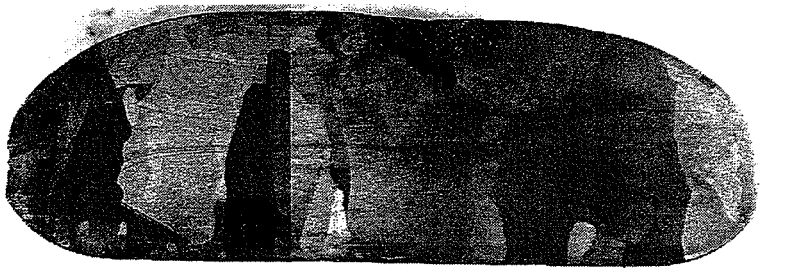
FIGS. 30 (*a*) to (*d*) are optical photomicrographs of cross sections of Sample No. 14 (Reference Example), and Nos. 15, 17 and 19 (Examples).
Figure 30:
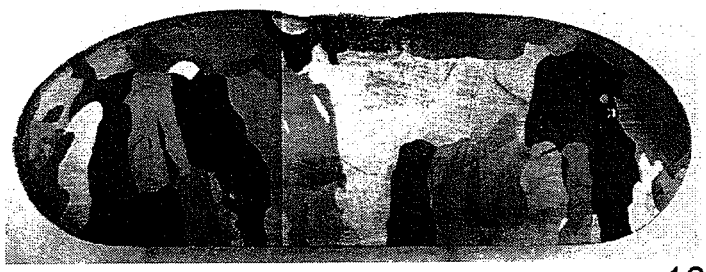
Figure 30:
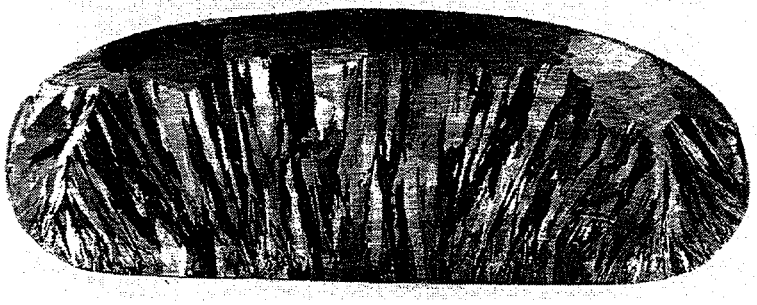
Figure 30:
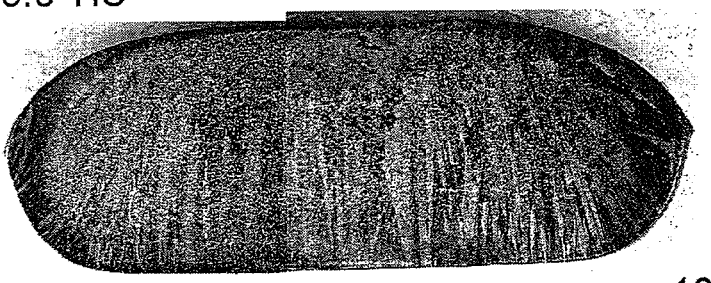

Cross sections of the samples prepared were observed with an optical microscope. FIG. 30 shows photographs of the cross sections of No. 14, No. 15, No. 17 and No. 19. In FIG. 30, the photographs of (a), (b), (c) and (d) correspond to the photographs of Sample Nos. 14, 15, 17 and 19, respectively.

FIG. 30 shows that crystal grain refinement occurred in No. 15, No. 17 and No. 19. In addition, external observation of Nos. 14 to 19 has revealed that the crystal grain refinement took place when the amount of TiC added is between 0.2 at. % and 0.5 at. %. This result is the same as in the experiment with the addition of NbC (Nos. 1 to 6).

Next, the samples prepared were subjected to the heat treatment in a vacuum at 1553 K for 3 hours as solution heat treatment.

In this experiment, the solution heat treatment serves as the first heat treatment, and the subsequent furnace cooling corresponds to the cooling to the temperature at which the $L1_2$ phase and the $D0_{22}$ phase coexist.

(Microstructure Observation)

Figure 31:
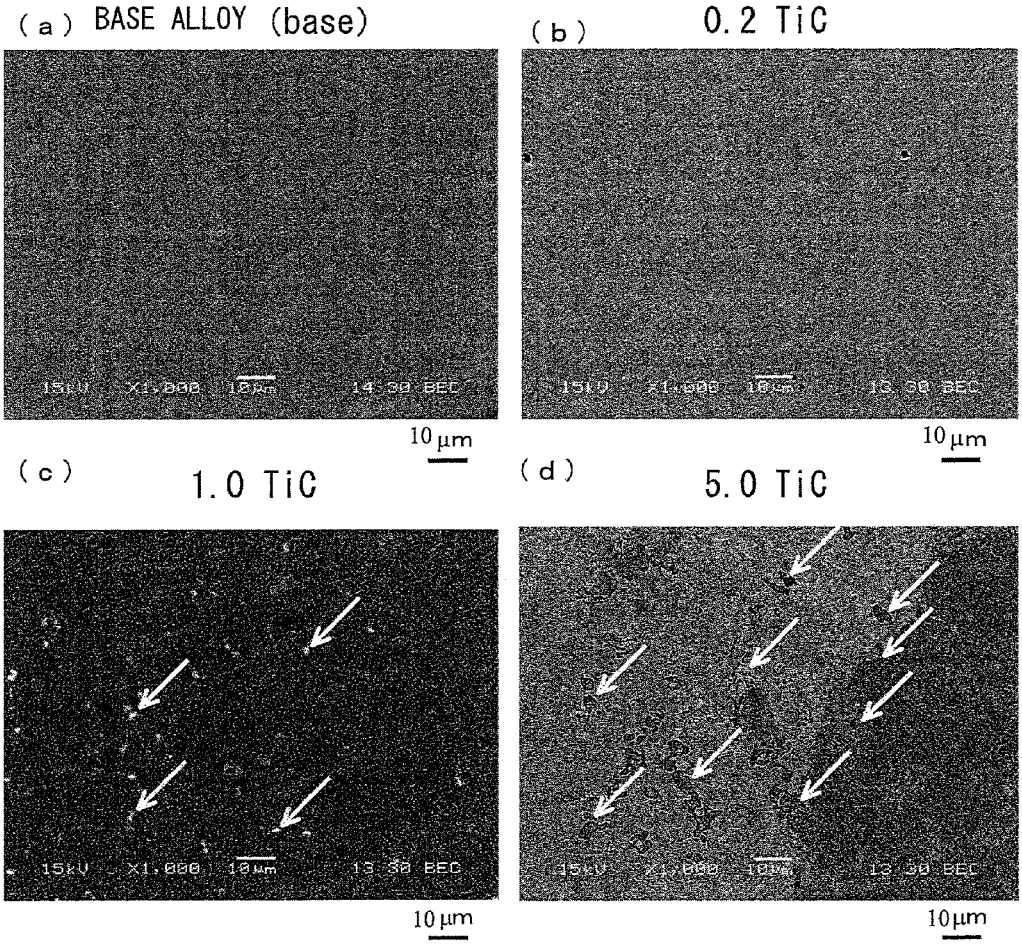
FIGS. 31 (*a*) to (*d*) are SEM photographs (1000 times) of Sample No. 14 (Reference Example), and Nos. 15, 17 and 19 (Examples).
Figure 32:
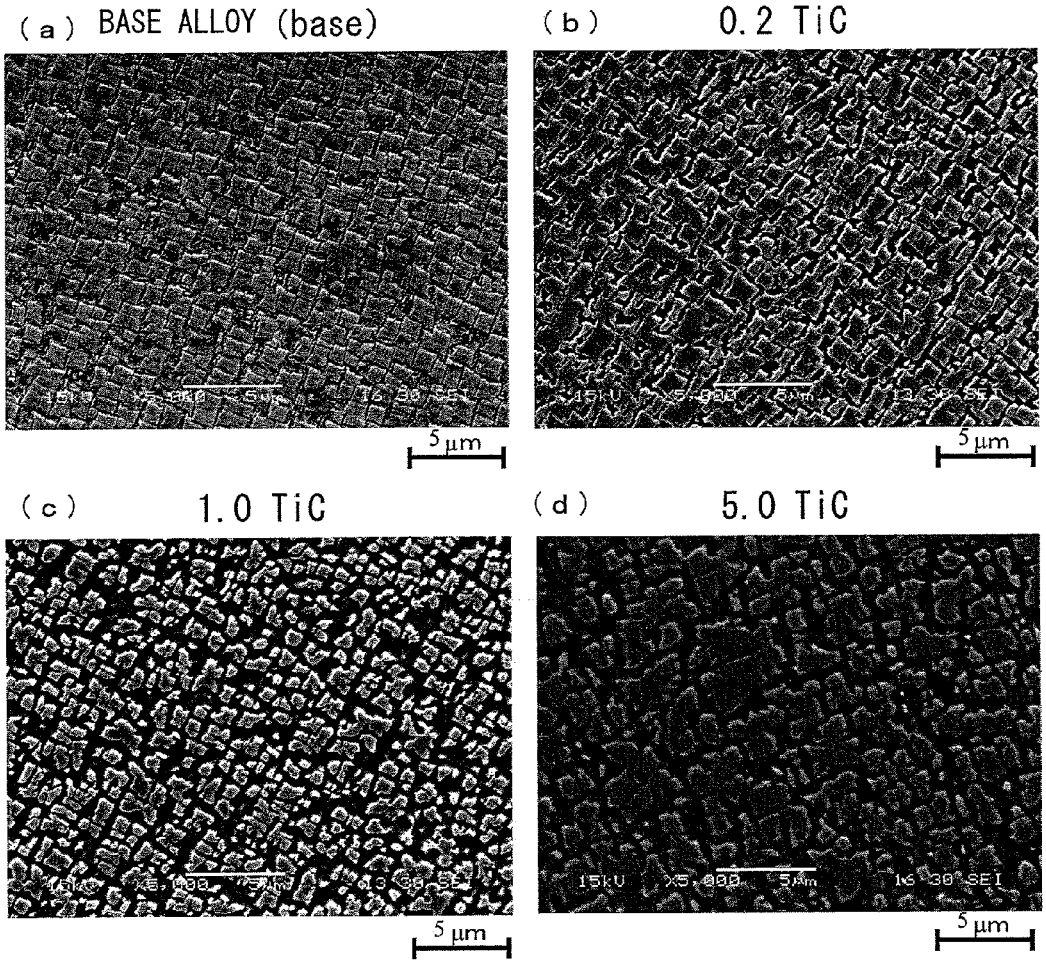
FIGS. 32 (*a*) to (*d*) are SEM photographs (5000 times) of Sample No. 14 (Reference Example), and Nos. 15, 17 and 19 (Examples).
Figure 33:
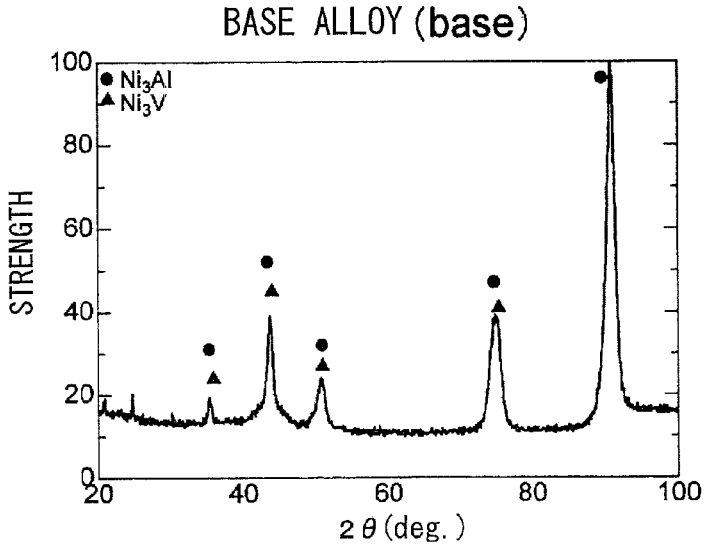
FIG. 33 is a graph showing a result of an X-ray measurement on Sample No. 14 (base) (Reference Example).
Figure 34:
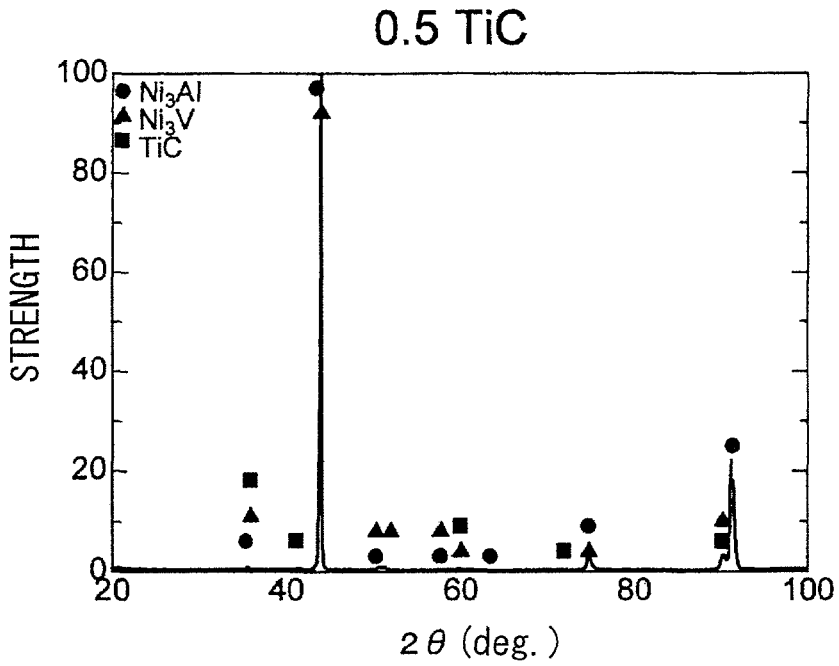
FIG. 34 is a graph showing a result of an X-ray measurement on Sample No. 16 (0.5 atomic % TiC) (Example).
Figure 35:
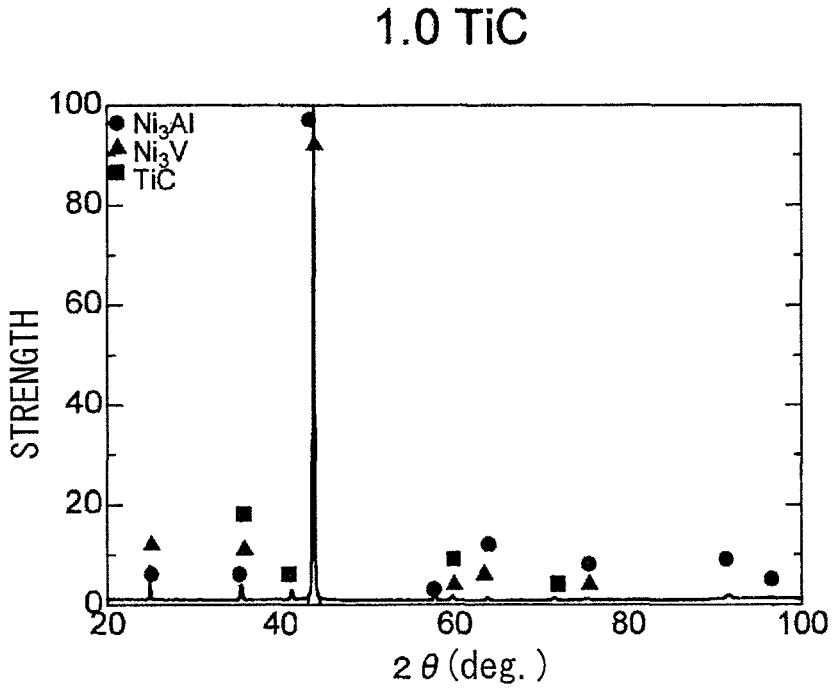
FIG. 35 is a graph showing a result of an X-ray measurement on Sample No. 17 (1.0 atomic % TiC) (Example).
Figure 36:
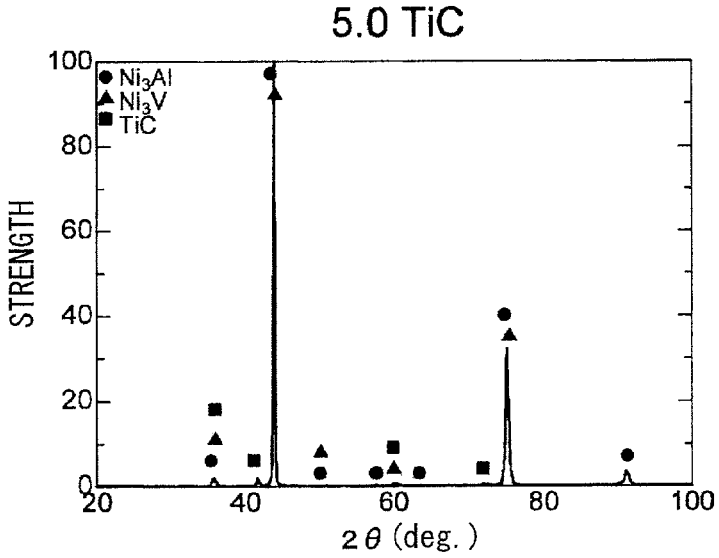
FIG. 36 is a graph showing a result of an X-ray measurement on Sample No. 19 (5.0 atomic % TiC) (Example).

Next, microstructure observation by an SEM was performed on the samples after the heat treatment. FIGS. 31 and 32 show photographs obtained. FIG. 31 shows SEM photographs of Sample Nos. 14, 15, 17 and 19 (1000 times), and FIG. 32 shows SEM photographs of the parent phases (matrix) in the same samples observed at a higher magnification (5000 times). In FIGS. 31 and 32, the photographs of (a), (b), (c) and (d) correspond to Sample Nos. 14, 15, 17 and 19, respectively.

FIG. 31 shows that second phase particles, which are considered carbide, exist in Sample Nos. 17 and 19 out of the samples containing TiC (areas pointed at by arrows in FIG. 31), whereas no second phase particles exist in Sample Nos. 14 and 15.

FIG. 32 shows that a dual multi-phase microstructure was formed in the parent phases of each sample regardless of whether TiC was added or not. FIG. 32 also shows that a primary precipitate $L1_2$ phase and a eutectoid microstructure were formed in the parent phases of each sample. The results have revealed that the dual multi-phase microstructure can be maintained even when C is introduced into an intermetallic compound through addition of TiC. This is the same as in the case of the addition of NbC.

(Composition Analysis)

Composition analysis was performed with an EPMA on the parent phases and the carbide (second phase particles) of each sample after the heat treatment. Tables 12 and 13 show the analysis results. Table 12 shows the result of the composition analysis on the parent phases (matrix) in Sample No. 14, and Table 13 shows the result of the composition analysis on the parent phases (matrix) and the carbide (second phase particles: represented as "Dispersion" in the table) in Sample No. 19. Sample No. 14 is shown for composition comparison with Sample No. 19 in which the carbide (second phase particles) was observed. All the numerical values in Tables 12 and 13 are expressed in atomic % (at. %).

TABLE 12

| Base | Ni | Al | V | Nb | Ti | C |
|---|---|---|---|---|---|---|
| Matrix | 74.8 | 8.6 | 12.3 | 3.4 | — | — |

TABLE 13

| 5.0 TiC | Ni | Al | V | Nb | Ti | C |
|---|---|---|---|---|---|---|
| Matrix | 73.9 | 9.3 | 10.4 | 1.10 | 3.32 | 1.97 |
| Dispersion | 1.59 | 0.016 | 23.0 | 21.6 | 18.3 | 35.5 |

Tables 12 and 13 show that the parent phases of Sample No. 19 have lower V and Nb concentrations and higher Ti and C concentrations than the parent phases of Sample No. 14. It is also shown that the carbide (second phase particles) of Sample No. 19 has higher V and Nb concentrations as well as higher Ti and C concentrations. It is further shown that the ratio between the Ti concentration and the C concentration is not 1:1 both in the parent phases and the carbide in Sample No. 19. These results tell that TiC added was dissolved to form a new microstructure. The results also tell that addition of TiC resulted in distribution of Ti and C to the parent phases, and V and Nb to the carbide (second phase particles) to constitute respective solid solutions. The amounts of Ti and C that became the solid solution are different from each other, suggesting that the dual multi-phase microstructure can be formed even when Ti and C, instead of TiC, are separately introduced into a sample. This indicates that the dual multi-phase microstructure can be formed even when Nb and C are separately introduced into a sample, which is the same result as in the experiment with the addition of NbC (Nos. 1 to 6).

(Phase Identification)

Next, an X-ray measurement was performed on each sample after the heat treatment for identification of the phases in the microstructure. FIGS. 33 to 36 show the measurement results. FIGS. 33 to 36 show X-ray diffraction profiles of Sample Nos. 14, 16, 17 and 19, respectively. The marks in the drawings represent peak positions of $Ni_3Al$ ($L1_2$ phase), $Ni_3V$ ($D0_{22}$ phase) and TiC, which are materials forming the dual multi-phase microstructure. These peak positions are represented by circular dots, triangular dots and quadrangular dots.

As shown in FIGS. 33 to 36, peaks derived from TiC were observed in No. 16, No. 17 and No. 19. Peaks derived from $Ni_3Al$ ($L1_2$ phase) and $Ni_3V$ ($D0_{22}$ phase) were observed in all of Sample Nos. 14, 16, 17 and 19. These results have revealed that except for the peaks of NbC, no other phases than $Ni_3Al$ ($L1_2$ phase) and $Ni_3V$ ($D0_{22}$ phase), which are the constituent phases of the dual multi-phase microstructure, was formed in all the samples, regardless of whether TiC was added or not. It has been also revealed that the carbide (second phase particles) observed in the microstructure is TiC.

(Vickers' Hardness Test)

Next, a Vickers' hardness test was performed on Sample Nos. 14 to 19. In the Vickers' hardness test, a square pyramid diamond indenter was pushed into each sample at room temperature. The load was mainly 300 g, and the retention time was 20 seconds.

Figure 37:
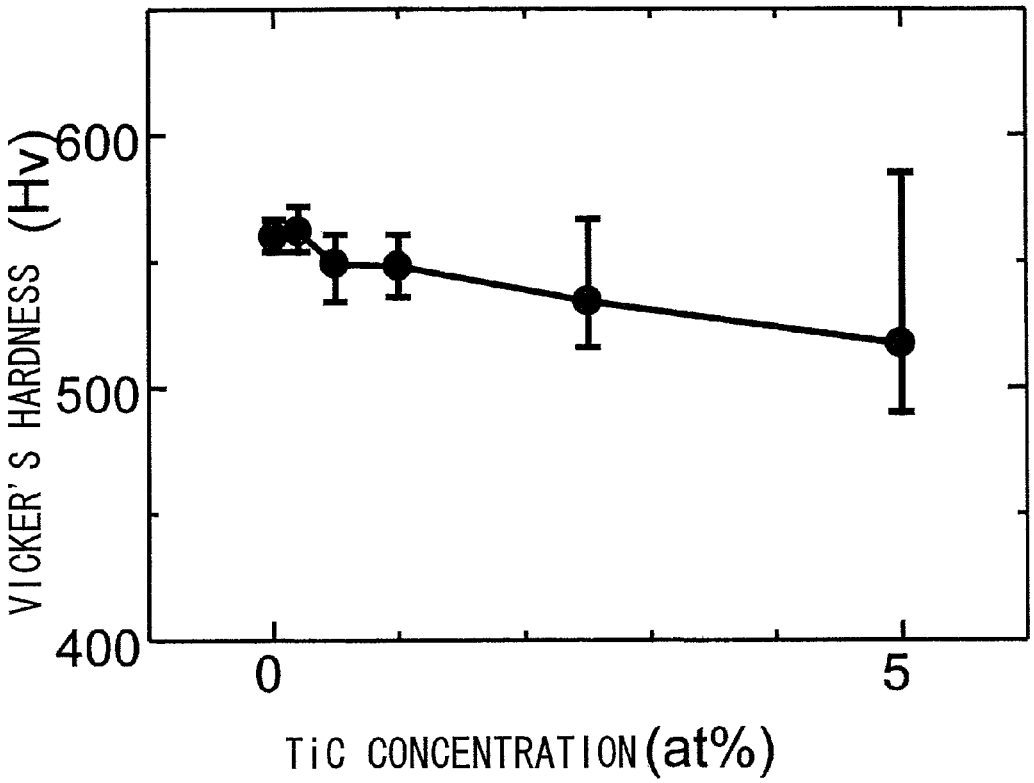
FIG. 37 is a graph showing the relationship between the amount of TiC added and the room-temperature Vickers' hardness of Sample No. 14 (Reference Example) and Nos. 15 to 19 (Examples).

FIG. 37 shows the test results. FIG. 37 is a graph showing the relationship between the amount of TiC added and the Vickers' hardness at room temperature.

FIG. 37 shows that the hardness is the maximum when TiC is not added (approximately 550 Hv) and the hardness decreases with increase in the amount of TiC added. Generally, metals have increased hardness when including impurities. However, it has been revealed that Sample Nos. 15 to 19 have decreased Vickers' hardness despite the addition of TiC.

(Tensile Test)

Next, a tensile test was performed on Sample Nos. 14 to 19. The tensile test was performed in a vacuum in a temperature range from room temperature to 1173 K at a strain rate of $1.67\times10^{-4}$ $s^{-1}$ using a test piece with a gage size of 10×2×1 $mm^3$. FIGS. 38 to 43 show the test results. FIGS. 38 to 43 are graphs showing the relationship of the yield strength, the tensile strength and the elongation versus the temperature for Sample Nos. 14 to 19.

Figure 38:
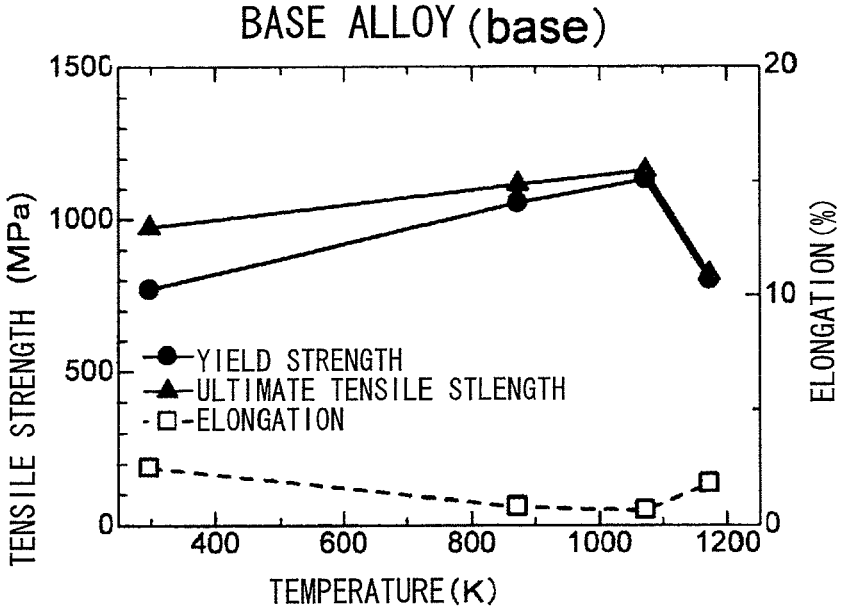
FIG. 38 is a graph showing a result of a measurement of Sample No. 14 (base) (Reference Example) for yield strength, tensile strength and elongation.
Figure 39:
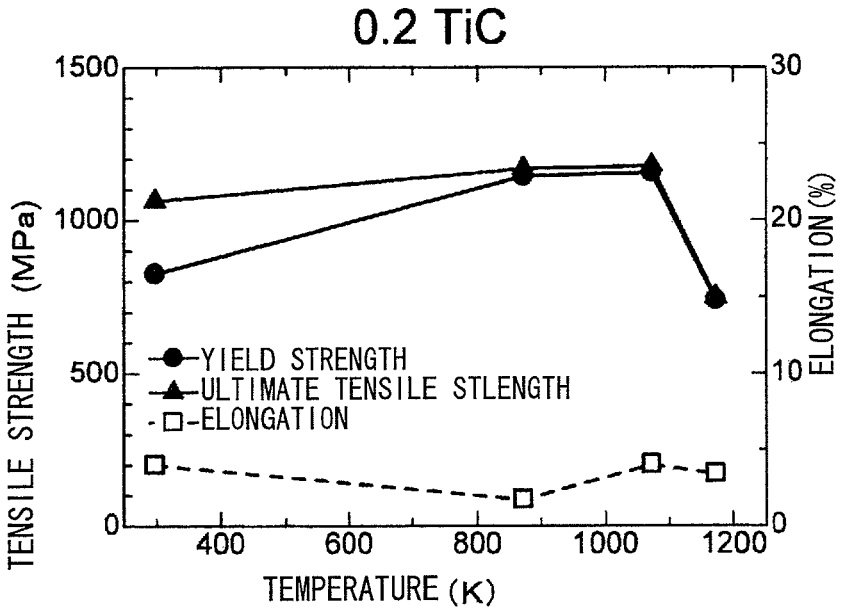
FIG. 39 is a graph showing a result of a measurement of Sample No. 15 (0.2 atomic % TiC) (Example) for yield strength, tensile strength and elongation.
Figure 40:
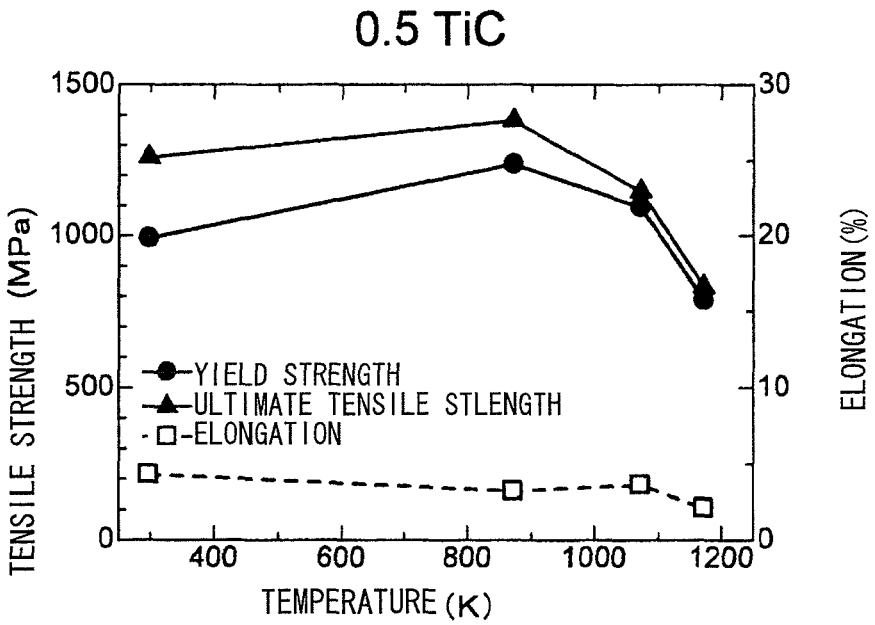
FIG. 40 is a graph showing a result of a measurement of Sample No. 16 (0.5 atomic % TiC) (Example) for yield strength, tensile strength and elongation.
Figure 41:
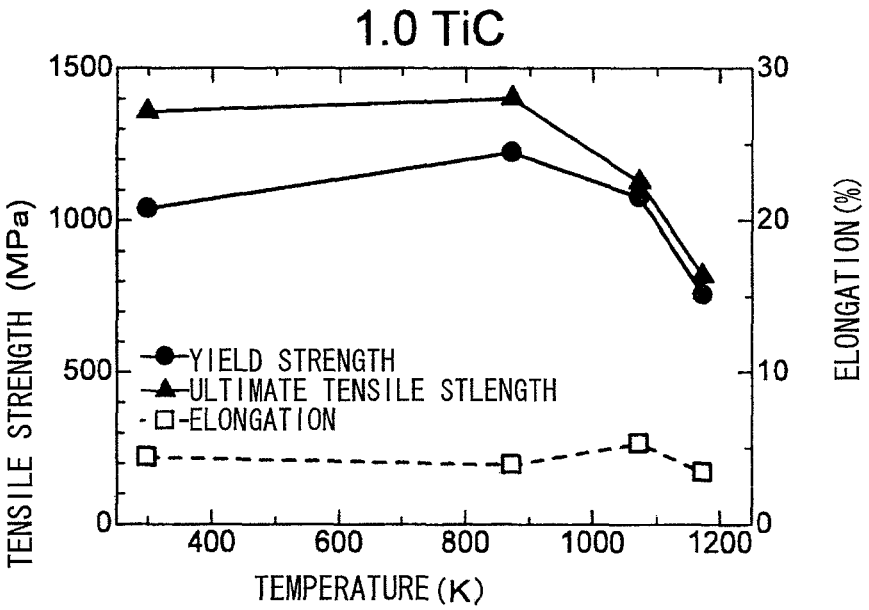
FIG. 41 is a graph showing a result of a measurement of Sample No. 17 (1.0 atomic % TiC) (Example) for yield strength, tensile strength and elongation.
Figure 42:
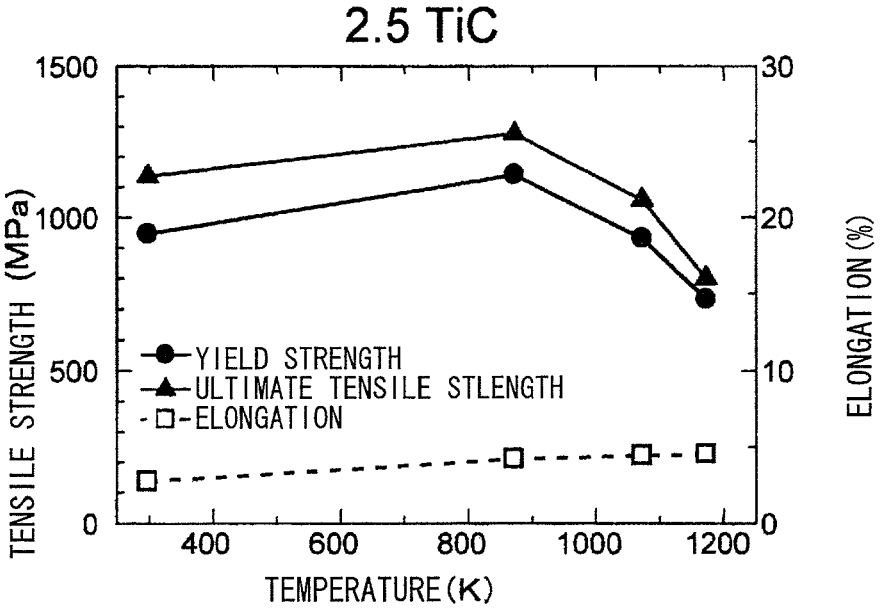
FIG. 42 is a graph showing a result of a measurement of Sample No. 18 (2.5 atomic % TiC) (Example) for yield strength, tensile strength and elongation.
Figure 43:
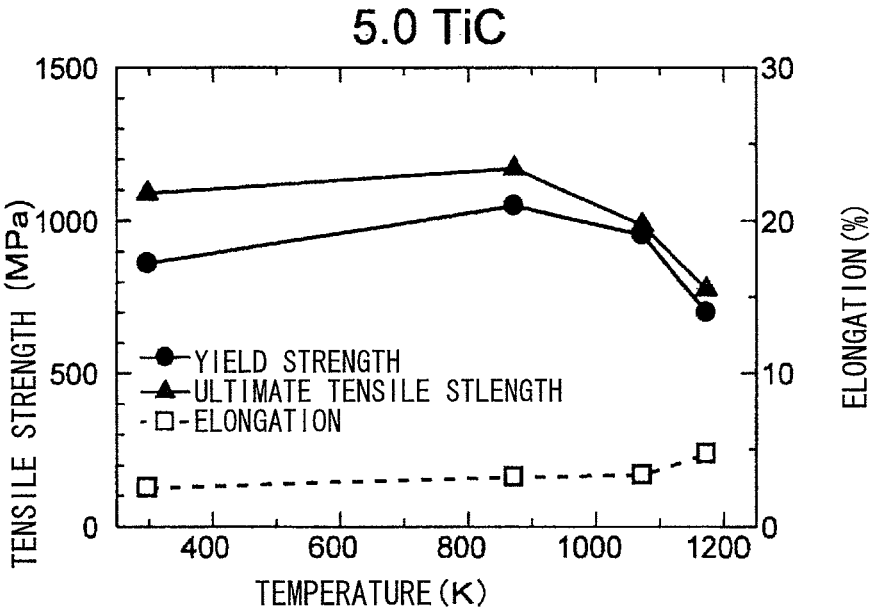
FIG. 43 is a graph showing a result of a measurement of Sample No. 19 (5.0 atomic % TiC) (Example) for yield strength, tensile strength and elongation.

FIGS. 38 to 43 indicate that the strength of the sample (No. 14) containing no TiC shows inverse temperature dependency up to approximately 1073 K (FIG. 38). That is, the value of the tensile strength increases with increase in temperature. Likewise, the graphs indicate that the strength of the samples (Nos. 15 to 19) containing TiC shows inverse temperature dependency up to 873 K or 1173 K (FIGS. 39 to 43). It is also indicated that the samples show elongations of 0.65% to 5.3% in the range of all the temperatures from room temperature to high temperature regardless of whether TiC was added or not. The elongations in the experiment with the addition of NbC (Nos. 1 to 6) were 0.3 to 4.7%, showing similar tendency.

Next, FIGS. 44 to 47 show the relationship of the yield strength, the tensile strength and the elongation versus the amount of TiC added. FIGS. 44 to 47 are graphs for analysis of results of the tensile test on Sample Nos. 14 to 19.

Figure 44:
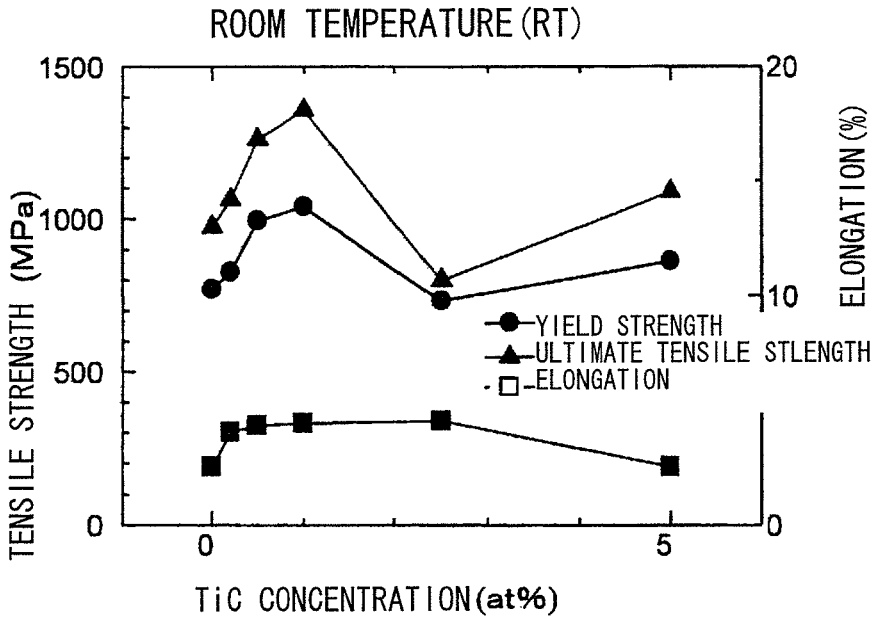
FIG. 44 is a graph showing the relationship of the yield strength, the tensile strength and the elongation versus the TiC concentration for Sample No. 14 (Reference Example) and Nos. 15 to 19 (Examples) at room temperature (RT).

FIG. 44 indicates that, at room temperature (RT), all the characteristic values of the yield strength, the tensile strength and the elongation increase with increase in the amount of TiC added, and they reach maximums when the amount of TiC added is approximately 1 atomic %. In particular, the tensile strength exceeds 1.3 GPa when the amount of NbC added is approximately 1 atomic %, and the strength property is excellent when the amount of TiC added is at least 0.2 atomic % and less than 2.5 atomic %. The values of the yield strength, the tensile strength and the elongation tend to decrease with increase in the amount of TiC added once the amount of TiC added exceeds 1 atomic %. Still, it is indicated that the characteristics are comparable or superior to those of the sample containing no TiC (No. 14).

Figure 45:
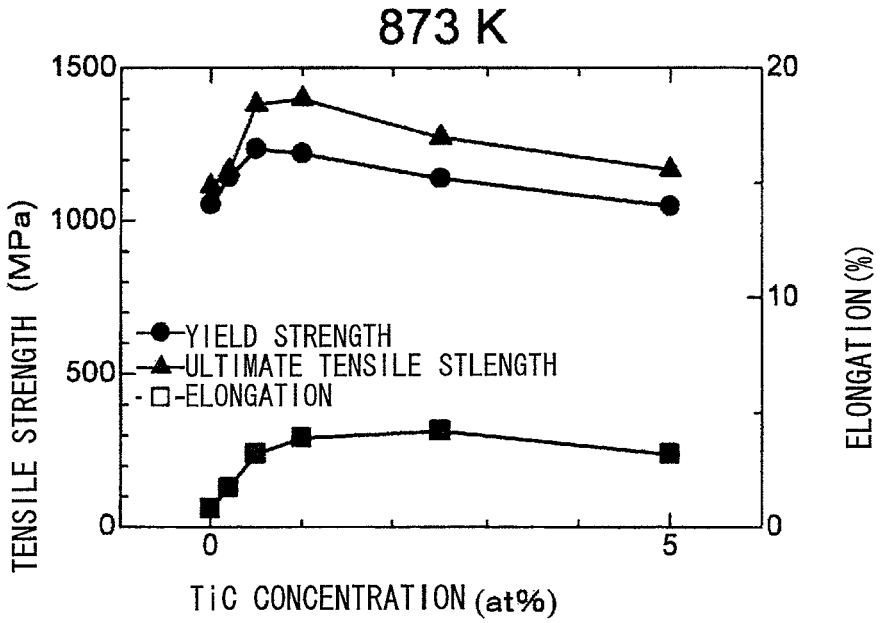
FIG. 45 is a graph showing the relationship of the yield strength, the tensile strength and the elongation versus the TiC concentration for Sample No. 14 (Reference Example) and Nos. 15 to 19 (Examples) at 873 K.

Likewise, FIG. 45 indicates that, at 873 K as in the case of room temperature, all the values of the yield strength, the tensile strength and the elongation increase with increase in the amount of TiC added, and they reach maximums when the amount of TiC added is approximately 1 atomic %. It is also indicated that the characteristic values slightly decrease or stay substantially constant once the amount of TiC added exceeds 1 atomic %. In particular, the strength characteristics are still excellent when the amount of TiC added is at least 0.2 atomic % and less than 2.5 atomic %.

Figure 46:
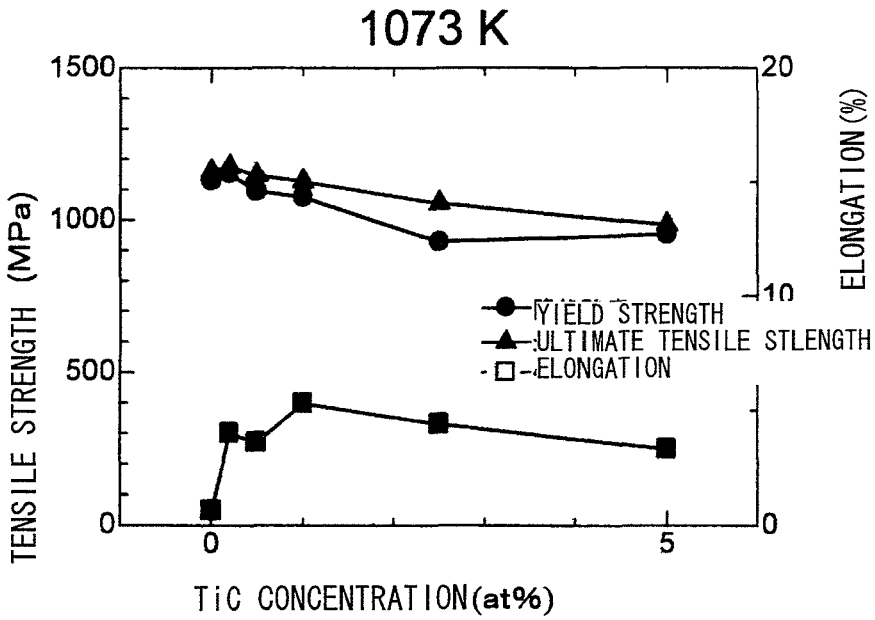
FIG. 46 is a graph showing the relationship of the yield strength, the tensile strength and the elongation versus the TiC concentration for Sample No. 14 (Reference Example) and Nos. 15 to 19 (Examples) at 1073 K.
Figure 47:
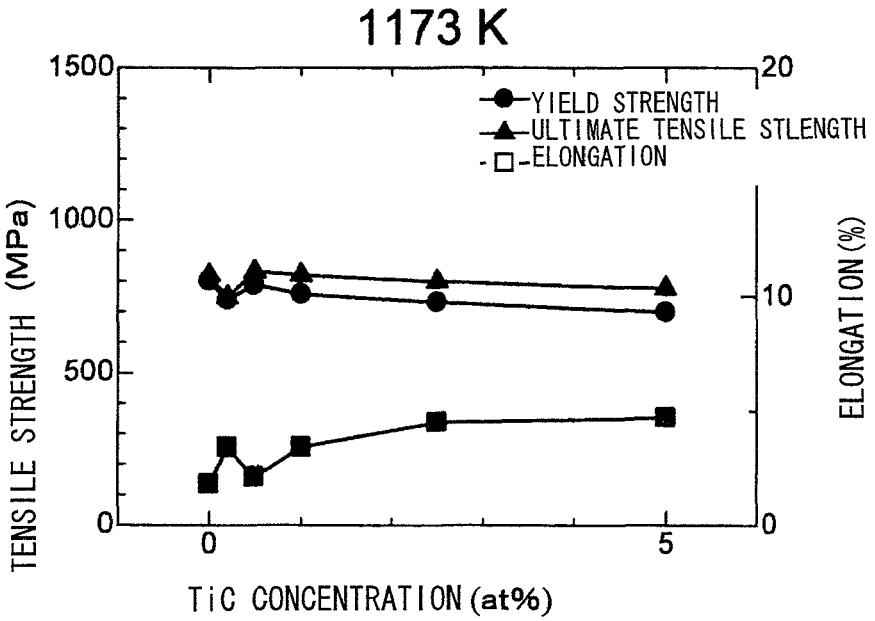
FIG. 47 is a graph showing the relationship of the yield strength, the tensile strength and the elongation versus the TiC concentration for Sample No. 14 (Reference Example) and Nos. 15 to 19 (Examples) at 1173 K.

Furthermore, FIGS. 46 and 47 indicate that the value of the elongation increases with increase in the amount of TiC added, and the value reaches a maximum or stays substantially constant once the amount of TiC added reaches approximately 1 atomic %.

These results have revealed that addition of TiC resulted in enhancement of the strength (yield strength and tensile strength) of the samples at room temperature. In particular, it has been revealed that the enhancement is significant when the amount of TiC added is less than 2.5 atomic %. It has been also revealed that the ductility (elongation) enhancement by the addition of TiC took place not only at room temperature but also at high temperature. In particular, the ductility is increased with increase in the amount of TiC added until the amount reaches 1 atomic %.

This is considered because C obtained through decomposition of TiC became a solid solution in the parent phases, causing solid solution strengthening, and the solid solution strengthening was effective in the low temperature range. The enhancement of the strength due to the addition of TiC is therefore significant when the temperature is from room temperature to 873 K.

Since the amount of C that can become a solid solution is limited (solid solubility limit), it is considered that the strength is enhanced with increase in the amount of TiC added until the amount of C reached the solubility limit, and the enhancement of the strength stops once the amount of C reached the solubility limit. This is considered a reason why the strength reaches a maximum when the amount of TiC added is approximately 1%.

Figure 48:
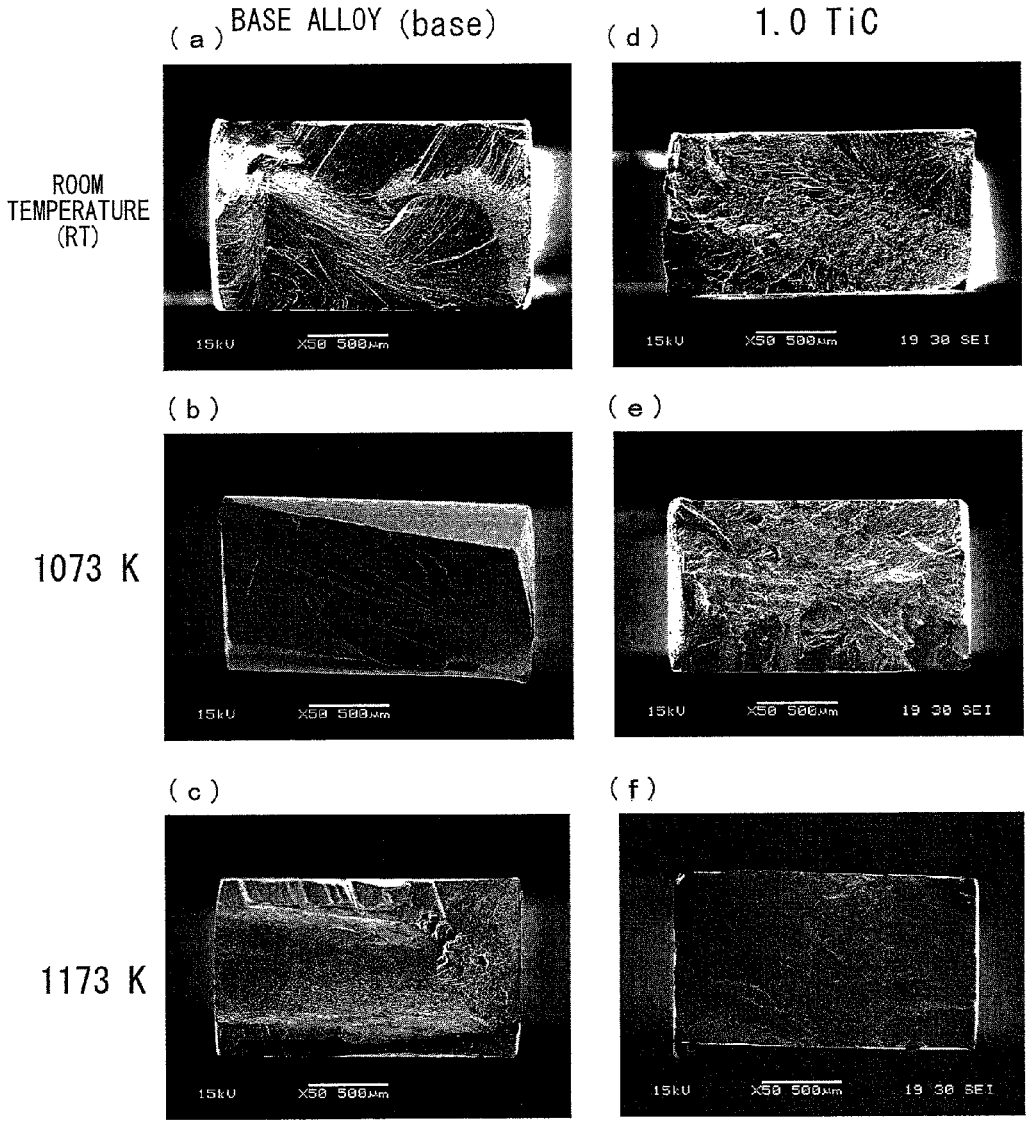
FIGS. 48 (*a*) to (*f*) are SEM photographs of fracture surfaces of No. 14 (Reference Example) and No. 17 (Example) after a tensile test.
Figure 49:
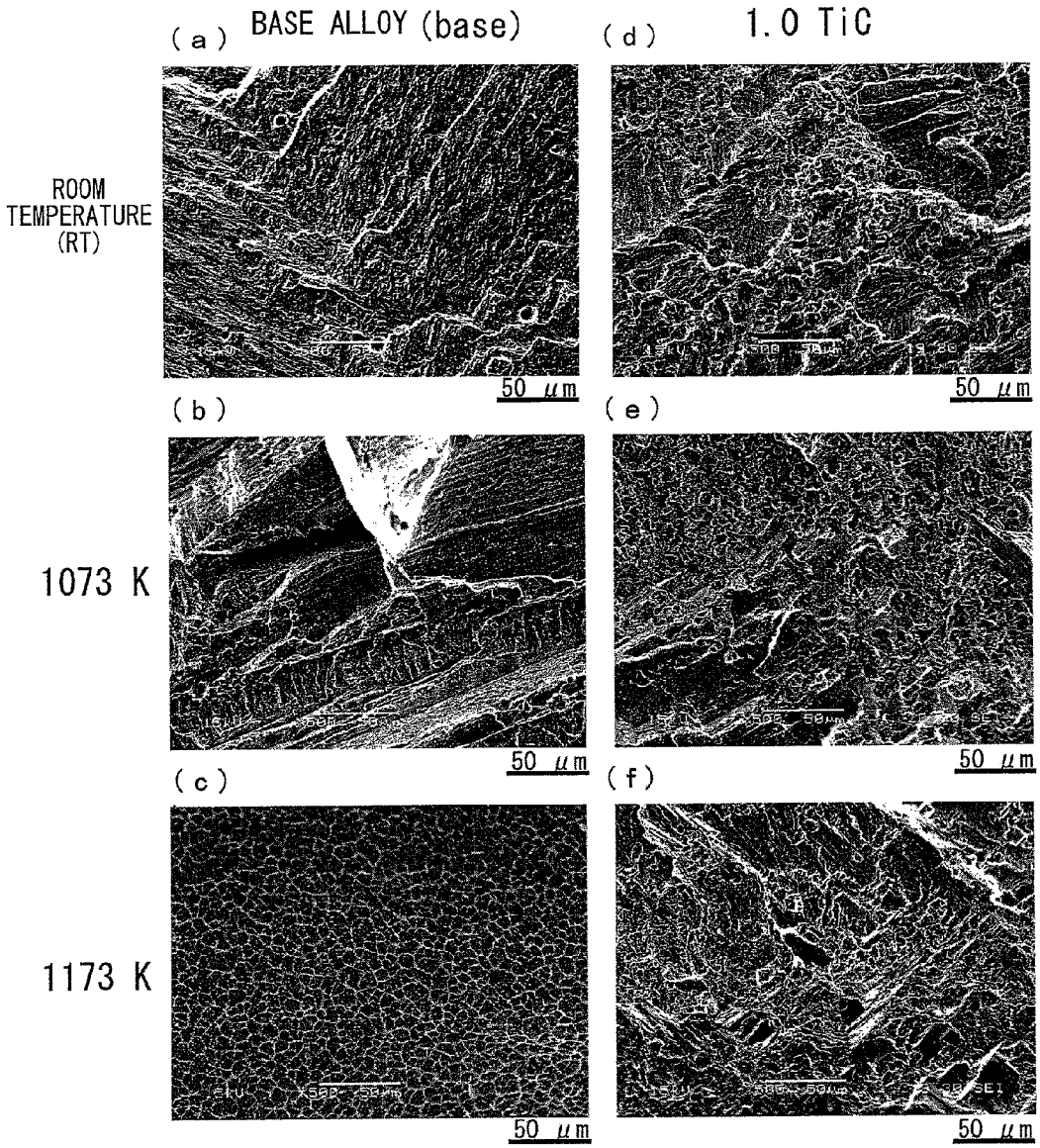
FIGS. 49 (*a*) to (*f*) are magnified SEM photographs of the fracture surfaces of No. 14 (Reference Example) and No. 17 (Example) after the tensile test.

Next, fracture surface observation was performed on each sample after the tensile test. FIGS. 48 and 49 show fracture surfaces of the samples. FIG. 48 shows SEM photographs (low-magnification photographs) of the fracture surfaces of Sample Nos. 14 and 17 after the tensile test at room temperature (RT), 1073 K and 1173 K, respectively. FIG. 49 shows magnified SEM photographs (high-magnification photographs) of the fracture surfaces of the samples in FIG. 48. In these drawings, (a), (b) and (c) show the fracture surfaces of Sample No. 14, and (d), (e) and (f) show the fracture surfaces of Sample No. 17.

As shown in FIGS. 48 and 49, Sample No. 14 takes on an aspect of quasi-cleavage fracture at room temperature and increases the tendency of intergranular fracture with increase in temperature. The intergranular fracture completely dominated at 1173 K ((a), (b) and (c) in FIGS. 48 and 49).

On the other hand, ductile transgranular fracture was observed in Sample No. 17 at room temperature to high temperature (1173 K). In addition, fracture mode having a dimple pattern was observed around the carbide (second phase particles) ((d), (e) and (f) in FIGS. 48 and 49). It was observed that the carbide was coarsened and thereby the cracking was caused when a large amount of carbide was added.

These results suggest that addition of TiC leads to inhibition of intergranular fracture, thereby causing transgranular fracture. Accordingly, the ductility is improved. In addition, observation of the carbide has revealed that carbon contributes to the ductility when added in an appropriate amount.

As described above, it has been confirmed that, as in the case of Nos. 2 to 6 (Examples 1 to 5), the tensile strength and the ductility characteristics were enhanced in the experiment in which C was added in the form of TiC separately from Nb (the enhancement was significant when the amount of TiC added was in particular less than 2.5 atomic % as in the case of the addition of NbC). This has also confirmed that C contributes to the enhancement of the tensile strength and ductility characteristics.

The invention claimed is:

1. An Ni-base intermetallic compound alloy, which comprises a dual multi-phase microstructure comprising a primary precipitate $L1_2$ phase and an ($L1_2$+$D0_{22}$) eutectoid microstructure, and which comprises:

more than 5 atomic % and up to 13 atomic % of Al;

at least 9.5 atomic % and less than 17.5 atomic % of V;

from 3.1 atomic % to 5.3 atomic % of Nb;

from 0.2 atomic % to 2.4 atomic % of C; and a remainder comprising Ni.

2. The Ni-base intermetallic compound alloy according to claim 1, formed by adding NbC to Al, V and Ni as the alloy materials.

3. The Ni-base intermetallic compound alloy according to claim 2, further comprising a different microstructure from the dual multi-phase microstructure, the different microstructure containing NbC.

4. The Ni-base intermetallic compound alloy according to claim 1, wherein Nb and C are contained as NbC.

5. The Ni-base intermetallic compound alloy according to claim 1, further comprising more than 0 ppm by weight and up to 1000 ppm by weight of B.

6. The Ni-base intermetallic compound alloy according to claim 5, wherein the B content is from 50 ppm by weight to 1000 ppm by weight.

7. The Ni-base intermetallic compound alloy according to claim 1, wherein the Al content is from 6 atomic % to 10 atomic %, and the V content is at least 12.0 atomic % and less than 16.5 atomic %.

8. A method for manufacturing an Ni-base intermetallic compound alloy, comprising the steps of:

preparing an ingot from a molten metal containing more than 5 atomic % and up to 13 atomic % of Al, at least 9.5 atomic % and less than 17.5 atomic % of V, more than 0 atomic % and up to 12.5 atomic % of Nb, more than 0 atomic % and up to 12.5 atomic % of C, and a remainder comprising Ni;

giving a first heat treatment to the ingot at a temperature at which a primary precipitate $L1_2$ phase and an A1 phase coexist; and decomposing the A1 phase into an $L1_2$ phase and a $D0_{22}$ phase by cooling after the first heat treatment.

9. The method for manufacturing an Ni-base intermetallic compound alloy according to claim 8, further comprising homogenization heat treatment or solution heat treatment.

10. The method for manufacturing an Ni-base intermetallic compound alloy according to claim 9, wherein the homogenization heat treatment or the solution heat treatment is performed at a temperature from 1503 K to 1603 K.

11. A method for manufacturing an Ni-base intermetallic compound alloy, comprising the steps of:

forming a microstructure in which a primary precipitate $L1_2$ phase and an A1 phase coexist by slow cooling a molten metal containing alloy materials including Ni as a main component, more than 5 atomic % and up to 13 atomic % of Al, at least 9.5 atomic % and less than 17.5 atomic % of V, and more than 0 atomic % and up to 12.5 atomic % of NbC; and decomposing the A1 phase into an $L1_2$ phase and a $D0_{22}$ phase by cooling the microstructure in which the primary precipitate $L1_2$ phase and the A1 phase coexist.

12. The method for manufacturing an Ni-base intermetallic compound alloy according to claim 11, wherein the NbC content is more than 0 atomic % and up to 4.6 atomic %.

13. An Ni-base intermetallic compound alloy obtainable by the manufacturing method according to claim 11, the alloy comprising a dual multi-phase microstructure and a microstructure containing NbC.

14. A method for manufacturing an Ni-base intermetallic compound alloy, comprising the steps of:

preparing an ingot from a molten metal containing alloy materials including Ni as a main component, more than 5 atomic % and up to 13 atomic % of Al, at least 9.5 atomic % and less than 17.5 atomic % of V, and more than 0 atomic % and up to 12.5 atomic % of NbC;

giving a first heat treatment to the ingot at a temperature at which a primary precipitate $L1_2$ phase and an A1 phase coexist; and decomposing the A1 phase into an $L1_2$ phase and a $D0_{22}$ phase by cooling after the first heat treatment.

* * * * *